US006674983B2

(12) United States Patent
Enomoto et al.

(10) Patent No.: US 6,674,983 B2
(45) Date of Patent: Jan. 6, 2004

(54) IMAGE FORMING APPARATUS AND SHEET FEEDER

(75) Inventors: Kazuo Enomoto, Iwatsuki (JP); Kazuhiro Iihara, Iwatsuki (JP); Toshiaki Misu, Iwatsuki (JP); Masakuni Nishimura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 140 days.

(21) Appl. No.: 09/954,050

(22) Filed: Sep. 18, 2001

(65) Prior Publication Data

US 2002/0061206 A1 May 23, 2002

(30) Foreign Application Priority Data

Nov. 20, 2000 (JP) ..... 2000-353334
Nov. 20, 2000 (JP) ..... 2000-353574

(51) Int. Cl.[7] ..... G03G 15/00; G03G 21/00; B65H 3/44; B65H 3/06

(52) U.S. Cl. ..... 399/124; 271/9.11; 271/117; 399/391

(58) Field of Search ..... 399/21, 124, 381, 399/391, 393; 271/9.01, 9.11, 9.13, 117, 162, 164

(56) References Cited

U.S. PATENT DOCUMENTS 4,531,823 A * 7/1985 Deguchi et al. ..... 399/124
5,157,448 A * 10/1992 Lang ..... 399/393 R
5,228,673 A * 7/1993 Osonoe ..... 271/164 R
5,383,654 A * 1/1995 Iseda ..... 271/9.11 R
5,839,032 A * 11/1998 Yasui et al. ..... 399/124
6,075,958 A * 6/2000 Gotoh et al. ..... 399/124
6,236,824 B1 * 5/2001 Pardubitzki ..... 399/124
6,473,576 B1 * 10/2002 Koshimizu et al. ..... 399/393 X

FOREIGN PATENT DOCUMENTS

JP A 7-219298 8/1995
JP A 11-84981 3/1999

* cited by examiner

*Primary Examiner*—Fred L. Braun
(74) *Attorney, Agent, or Firm*—Oliff & Berridge, PLC

(57) ABSTRACT

An image forming apparatus and sheet feeder in which a recording-material transporting system is provided for transporting to an image forming section recording material supplied from a recording-material supplying section and for subsequently guiding the recording material to a recording-material discharging section. A portion of the transporting path is arranged on a rear side of the apparatus body located on an opposite side to the user operation side. At least either one of the recording-material supplying section and the recording-material transporting system is provided with a jam clearing section for allowing recording material jammed in the recording-material transporting system to be both accessed from and cleared on the user operation side without need to open any access panels on the side portions or rear portion of the apparatus body. As a result the apparatus may be located without reserving space for opening a side or rear access portion.

19 Claims, 25 Drawing Sheets

IMAGE FORMING APPARATUS AND SHEET FEEDER

BACKGROUND OF THE INVENTION

1. Technical Field

The present invention relates to an image forming apparatus such a printer, a copying machine, and a facsimile machine, and more particularly to improvements of an image forming apparatus in which a rear-side transporting path is included as at least a portion of recording-material transporting paths.

Further, the present invention relates to a sheet feeder for use in such as a printer, a copying machine, and a facsimile machine, and more particularly to improvements of a sheet feeder of the type in which sheets are fed from the innermost recess side of a sheet tray in the inserting direction thereof, the sheet tray being disposed in such a manner as to be capable of being inserted or pulled out. The sheet used in the present invention has a size in a range of a size from a postcard to the JIS standard A3 size for a machine drawing including a legal size.

2. Related Art

As a conventional image forming apparatus of this type, one is already known which is comprised of a printer unit incorporating an image forming engine inside an apparatus body and adapted to form an image on a recording material (paper, an OHP sheet, and the like) by means of this image forming engine; a discharge tray disposed above this printer unit to discharge and accommodate the recording material for which the image formation by the printer unit is completed; a recording-material supplying unit which is disposed below the printer unit, in which a recording material cassette for accommodating the recording material is loaded in the apparatus body in such a manner as to be capable of being pulled out from a user operation side (normally, this side of the apparatus body), and in which the user operation-side surface of the recording material cassette is set substantially flush with a surface of the apparatus body; and a recording-material transporting system in which transporting paths are provided for transporting to the printer unit the recording material supplied from the recording-material supplying unit and for guiding the recording material to the discharge tray (e.g., JP-A-7-219298).

This mode is preferable in that, in terms of the shape of the image forming apparatus, it is possible to adopt a basic configuration of a box type having no external projections while the installation space of the image forming apparatus is kept to the range of the recording-material supplying unit.

Incidentally, in image forming apparatuses of this type, a recording-material transporting system of a mode which has recording-material transporting paths extending in the left-and-right direction as viewed from the user operation side is frequently adopted.

In addition, in such image forming apparatuses as compact printers, a recording-material transporting system is already present which has recording-material transporting paths extending in the back-and-forth direction as viewed from the user operation side.

Further, as a conventionally known printer, one is known which is comprised of, for example, a paper feeding tray disposed in such a manner as to be capable of being inserted or pulled out from this side of the apparatus; a paper feeding section disposed on the innermost recess side of the paper feeding tray in the inserting direction thereof and adapted to separate and feed one by one the paper accommodated in the paper feeding tray; an image forming section disposed above the paper feeding tray to form an image on the paper thus fed; and a discharge tray for discharging the paper, after being subjected to image formation, from the innermost recess side of the apparatus toward this side (refer to JP-A-11-84981).

In this type of printer, since the above-described configuration is adopted, the paper feeding passages are substantially formed in a U-shape, and the paper transporting passages are provided on the innermost recess side as viewed in the inserting direction of the paper feeding tray, i.e., on the innermost recess side of the main body of the printer.

With such a printer, since the replacement of the paper feeding tray is required in correspondence with the print size, there is a problem in that the operation becomes complicated correspondingly.

Accordingly, a printer is conventionally known in which one or a plurality of separate paper feeding units are further disposed on the lower side of the main body of the printer to make it possible to feed paper corresponding to the print size.

Here, as the paper feeding unit, one is used which has a paper feeding tray disposed in the main body of the paper feeding unit in such a manner as to be capable of being inserted or pulled out and a paper feeding section disposed on the innermost recess side of the paper feeding tray in the inserting direction thereof and adapted to separate and feed one by one the paper accommodated in the paper feeding tray. By adopting this arrangement, the paper transporting passages in the paper feeding unit can be set on the innermost recess side, so that the paper fed out from the paper feeding unit can be smoothly delivered to the main body side of the printer.

[Problems to be Solved]

However, with the image forming apparatus of the above-described mode (the mode in which the discharge tray is provided above the printer unit, and the recording-material supplying unit is provided below the printer unit), in the case where the recording-material transporting paths extending in the left-and-right direction as viewed from the user operation side are adopted, since the transporting paths are generally disposed laterally of the apparatus body in supplying the recording material in the recording-material supplying unit on the lower side to the printer unit on the upper side, if a jam of the recording material is occurred in, for instance, the lateral transporting path, the jam must be cleared after opening a side cover of the apparatus body. Thus, it is inevitable to secure a jam clearing space (a space for opening the side cover) on the side of the apparatus body.

On the other hand, with the image forming apparatus of the above-described mode, in the case where the recording-material transporting paths extending in the back-and-forth direction as viewed from the user operation side are adopted, the transporting paths are generally disposed on the user operation side (this side) of the apparatus body or on the opposite side thereof (rear side).

At this time, in the mode in which all the transporting paths are arranged on this side of the apparatus body, in a case where the recording material is jammed in the transporting path on this side, the jam can be cleared after pulling out the recording material cassette or opening the front cover of the printer unit. However, due to the limitations imposed on the transporting paths of the recording material, the degree of freedom in the configuration or layout of the image forming engine inside the printer unit is impaired.

Meanwhile, in the mode in which the rear-side transporting path is included as a portion of the transporting paths, an arrangement generally provided is such that if a jam of the recording material occurs in the rear-side transporting path, a rear cover is opened to effect the clearing of the jam. Therefore, there is a technical problem in that the installation space of the image forming apparatus must be made wider on the rear side than the area occupied by the image forming apparatus by the portion required for opening or closing the rear cover.

In addition, although a technique is proposed in which, by making use of the space from which the recording material cassette is pulled out, the recording material which is jammed in the rear-side transporting path is manually removed (JP-A-11-84981), this type of technique is premised on the fact that the recording material cassette projects from the apparatus body toward the user operation side, and that the back-and-forth dimension of the apparatus body is small. Hence, this type of technique is difficult to apply to a mode in which the recording material cassette is accommodated in the apparatus body such that the user operation-side surface of the recording material cassette becomes substantially flush with the surface of the apparatus body.

Namely, in a case where a recording material cassette is used which is capable of accommodating a recording material whose maximum size is, for instance, the JIS standard A3 size, the recording-material supplying unit must have such a back-and-forth dimension that allows at least the recording material cassette to be accommodated in the apparatus body. For this reason, when the recording material is jammed in the rear-side transporting path, even if the user, after pulling out the recording material cassette, tries to clear the jam by making use of the space from which the recording material cassette was pulled out, the user's hand does not reach the rear-side transporting path, and the clearing of the jam is extremely difficult.

Further, with the above-described paper feeding unit, paper jams can occur during the transport of the paper. As a technique for clearing such a paper jam, one is known in which an openable door which also serves as a paper transporting chute is provided on the innermost recess side of the main body of the paper feeding unit, and as this door is opened, the jammed paper can be removed (refer to JP-A-11-84981).

However, in a case where such a technique is adopted, in view of the occurrence of the paper jam, a space where the door can be opened and a space for allowing an access by an operator must be secured on the rear side of the paper feeding unit, i.e., on the rear side of the printer. Therefore, there has been a technical problem in that a substantial occupying area becomes large correspondingly, so that the space efficiency declines.

SUMMARY OF THE INVENTION

The invention is devised to overcome the above-described technical problems, and its object is to provide an image forming apparatus requiring only a small installation area without securing a wasteful space for clearing a jam.

Further, the invention has been devised to overcome the above-described technical problems, and its object is to provide a sheet feeder capable of easily removing the jammed sheet without causing a decline in the substantial space efficiency.

[Means for Solving the Problems]

Namely, in accordance with the invention, as shown in FIG. 1, there is provided an image forming apparatus comprising: an image forming section 1 incorporating an image forming engine 2 inside an apparatus body and adapted to form an image on a recording material by means of this image forming engine 2; a recording-material discharging section 3 disposed above this image forming section 1 to discharge and accommodate the recording material for which the image formation by the image forming section 1 is completed; a recording-material supplying section 4 which is disposed below the image forming section 1, in which a recording material cassette 5 for accommodating the recording material is loaded in the apparatus body in such a manner as to be capable of being pulled out from a user operation side, and in which a user operation-side surface of the recording material cassette 5 is set substantially flush with a surface of the apparatus body; and a recording-material transporting system 6 in which transporting paths are provided for transporting to the image forming section 1 the recording material supplied from the recording-material supplying section 4 and for subsequently guiding the recording material to the recording-material discharging section, and in which a portion of the transporting path leading to the image forming section is arranged on a rear side of the apparatus body located on an opposite side to the user operation side, wherein at least either one of the recording-material supplying section 4 and the recording-material transporting system 6 is provided with a jam clearing section 8 (e.g., 8*a*, 8*b*, and 8*c*) for allowing the recording material jammed in a rear-side transporting path 7 to be cleared on the user operation side.

In this technical means, the terms "image forming section 1" and "recording-material supplying section 4" in terms of their concepts respectively include the apparatus body (housing body), and both of these elements may be formed into units, or may be provided in a single apparatus body without being formed into units.

Incidentally, it goes without saying that the image forming section 1 may be provided with a recording-material supplying section such as a recording material tray 1*a* or a manual feeding tray 1*b*.

In addition, the recording-material supplying section 4 has as its object one in which the user operation-side surface of the recording material cassette 5 is substantially flush with the surface of the apparatus body, and does not include a mode in which the recording material cassette 5 projects from the apparatus body toward this side, and the recording material which jammed in the recording-material transporting system 6 arranged on the rear side of the apparatus body can therefore be easily removed manually.

In addition, the recording material cassette 5 referred to herein includes a mode in which the recording material cassette 5 is pulled out in a state in which it is not completely disengaged from the apparatus body or a mode in which the recording material cassette 5 is pulled out in a state in which it is completely disengaged from the apparatus body, insofar as the recording material cassette 5 can be loaded in the apparatus body in such a manner as to be capable of being pulled out.

Further, the recording-material transporting system 6 is sufficient if the rear-side transporting path 7 is provided in at least a portion of the transporting paths, and the mode in which the rear-side transporting path 7 is not provided is not included in the recording-material transporting system 6.

Furthermore, the jam clearing section 8 is sufficient if it allows the recording material which jammed in the rear-side transporting path 7 to be cleared on the user operation side, and it suffices if the jam clearing section 8 is provided in at least either one of the recording-material supplying section 4 and the recording-material transporting system 6.

Here, as the place where the jam clearing section 8 is provided, it is possible to cite a portion of the rear-side transporting path 7 where a jam is likely to occur, e.g., a portion where the transporting path is bent or an inlet portion of transporting members such as a pair of rolls.

In addition, as a typical mode of the jam clearing section 8 (8*a*) provided in the recording-material supplying section 4, it is possible to cite an arrangement in which, as shown in FIG. 1, in a mode in which the transporting path located immediately after the recording-material supplying section 4 is the rear-side transporting path 7, the recording material cassette 5 has a recording-material accommodating portion 5*a* for accommodating the recording material and a recording-material transporting portion 5*b* disposed on an innermost recess side of the recording-material accommodating portion 5*a*, and the jam clearing section 8*a* causes the recording-material transporting portion 5*b* to be exposed to an outside with the recording material nipped and held in the recording-material transporting portion 5*b* when the recording material cassette 5 is pulled out.

In this mode, the recording-material supplying section 4 preferably has a temporary stop mechanism for temporarily stopping the recording material cassette 5 when the recording material cassette 5 is pulled out to a position where the entire recording-material accommodating portion 5*a* is exposed to the outside, and as the temporary stop mechanism is unlatched, the recording material cassette 5 can be further pulled out.

According to this mode, the operation of loading the recording material and the operation of clearing a jam can be handled separately, and the excessive pulling out of the recording material cassette 5 during the operation of loading the recording material can be effectively prevented.

Further, to permit the clearing of a jam in the recording-material transporting system 6, it suffices if the recording-material transporting system 6 has an intermediate transport section 10 for constituting a portion of the rear-side transporting path, and the jam clearing section 8 (e.g., 8*b*) is provided in the intermediate transport section 10.

The intermediate transport section 10 is sufficient if it includes a portion of the rear-side transporting path. Although the arrangement of the rear-side transporting path 7 is not particularly restricted, the intermediate transport section 10 is preferably provided in a portion of the rear-side transporting path 7 where the clearing of a jam is likely to occur.

For example, in a mode in which the transporting paths for transporting to the image forming section 1 the recording material supplied from the recording-material supplying section 4 and for subsequently guiding the recording material to the recording-material discharging section 3 has a vertically transporting path which is offset in a back-and-forth direction as viewed from the user operation side, it suffices if the recording-material transporting system 6 has the intermediate transport section 10 in which a horizontally transporting path connecting mutually offset vertically transporting paths is disposed, and the jam clearing section 8 (8*b*) is provided in the intermediate transport section 10.

Further, as a typical mode of the jam clearing section 8 (8*b*) of the intermediate transport section 10, it is possible to cite an arrangement in which the jam clearing section 8 is arranged such that a recording-material transporting portion is provided on an innermost recess side of the intermediate transport section 10, the intermediate transport section 10 is made capable of being pulled out of the apparatus body from the user operation side, and the jam clearing section 8 (8*b*) causes the recording-material transporting portion to be exposed to an outside with the recording material nipped and held in the recording-material transporting portion when the intermediate transport section 10 is pulled out.

In addition, as a typical mode of the jam clearing section 8 (8*c*) of the recording-material transporting system 6, it is possible to cite an arrangement in which, for example, in a mode in which a detachable image forming engine 2 is disposed in the apparatus body, the jam clearing section 8 (8*c*) is arranged such that an openable cover 11 which can be opened or closed from the user operation side is provided on the apparatus body making up a part of the image forming section 1, and after the openable cover 11 is opened and the image forming engine 2 is detached, the recording material which jammed in the transporting path leading from the image forming section 1 to the recording-material discharging section 3 is cleared by making use of a space for detaching the image forming engine 2.

Here, although the openable cover 11 is provided on the apparatus body which makes up a part of the image forming section 1, the openable cover 11 may be provided at an arbitrary portion (on an upper portion or this side of the apparatus body portion of the image forming section 1) insofar as the jam can be cleared from the user operation side.

In this case, in the mode in which the openable cover 11 is provided on the upper portion of the apparatus body portion of the image forming section 1, it is preferable to adopt a mode in which the recording-material discharging section 3 is formed integrally on top of the apparatus body portion of the image forming section, and the recording-material discharging section 3 is provided with the openable cover 11.

However, in a case where the image forming section 1 and the recording-material discharging section 3 are formed as separate units, it suffices if the recording-material discharging section 3 is also provided with an openable cover which is separate from the openable cover 11 on the image forming section 1 side.

In addition, in the invention, in view of the appearance and the operational feature of the image forming apparatus, the image forming section 1 and the recording-material supplying section 4 are preferably formed such that their respective apparatus body portions located on the user operation side are made substantially flush.

In this case, for instance, in a mode in which an apparatus body portion of the image forming section 1 has an occupying area smaller than that of an apparatus body portion of the recording-material supplying section 4, to arrange the appearance of the image forming apparatus, it suffices if a dummy cover 12 is disposed on the user operation side or the rear side of the image forming section 1, such that an area occupied by the apparatus body portion of the image forming section 1 and the dummy cover 12 is substantially equal to the occupying area of the apparatus body portion of the recording-material supplying section 4.

Further, in the invention, to permit two-side image formation in the image forming section 1, the image forming section may have a recording-material-two-side transporting section (not shown) allowing formation of images on both sides of the recording material by the image forming engine 1.

Further, as a mode which further develops the invention, in a case where an image reading section 14 of an original fixed type is incorporated, it suffices if, as shown in FIG. 1, the image reading section 14 is provided which is disposed above the recording-material discharging section 3 with at least a space provided therebetween, the space being open on the user operation side, the image reading section 14 having an original placing table on which an original is fixed, so as to read an image of the original.

In this mode, in a mode in which the recording-material discharging section 3 is formed integrally on top of an apparatus body portion of the image forming section 1, and the recording-material discharging section 3 is provided with an openable cover 11 for attaching or detaching the image forming engine, the image reading section 14 is preferably disposed movably (rotatably or vertically movably) in a space above the recording-material discharging section 3 so as to make the space above the recording-material discharging section 3 more open.

In addition, from the viewpoint of arranging the appearance of the image forming apparatus, the image reading section 14, the image forming section 1, and the recording-material supplying section 4 are formed such that their respective apparatus body portions located on the user operation side are made substantially flush.

In this case, it goes without saying that a dummy cover or the like may be used, as required.

Further, in accordance with the invention, as shown in FIG. 25A, there is provided a sheet feeder characterized by comprising: a sheet tray 802 for accommodating sheets of paper S and disposed in such a manner as to be capable of being inserted or pulled out from the operation side of an apparatus body 801; and sheet feeding member 803 disposed on an innermost recess side of the sheet tray 802 in an inserting direction thereof so as to feed out the sheet S in the sheet tray 802, wherein there is provided an interlocking mechanism 804 for moving the sheet feeding member 803 in the same direction as that of the sheet tray 802 in interlocking relation to the sheet tray 802.

In the above-described technical means, the invention of this application has as its objects not only a sheet feeder used as an external unit for an image forming apparatus such as a printer but also a sheet feeder incorporated in the main body of the image forming apparatus.

In addition, the sheet feeding member 803 has the function of feeding out the sheet S and includes, for instance, a paying-out member for paying out the sheet S on the sheet tray 801, a transporting member for transporting the sheet S paid out, a guide member for forming the transporting passage of the sheet S being transported, and the like.

Further, as for the interlocking mechanism 804, insofar as it moves the sheet feeding member 803 in the same direction as that of the sheet tray 802 in interlocking relation to the sheet tray 802, a mode in which the sheet tray and the sheet feeding member are directly connected, a mode in which they are indirectly connected by means of a sliding member or the like, and other modes may be selected, as required.

Here, from the viewpoint of facilitating the loading of sheets in the sheet tray 802, it is preferable to avoid a situation in which the sheet feeding member 803 covers the sheet tray 802 pulled out of the apparatus body 801. From this viewpoint, the interlocking mechanism 804 should preferably be arranged such that, as shown in FIGS. 25A to 25C, the sheet feeding member 803 is moved so as to offset a relative positional relationship in a moving direction between the sheet tray 802 and the sheet feeding member 803.

Further, at the time of the loading of sheets, i.e., when only the sheet tray 802 is pulled out of the apparatus body, the interlocking mechanism 804 may be moved together with the sheet feeding member 803 as shown in FIG. 25B, or may be held at its initial position without being moved together with the sheet feeding member as shown in FIG. 25D.

In addition, the sheet feeding member 803 may be pulled out of the apparatus body 801 each time the sheet tray 802 is pulled out. However, since the pulled-out length becomes long, and mechanical portions such as the gears and rolls of the sheet feeding member 803 become exposed, the risk of causing faulty operation to the sheet feeding member 803 due to such as an erroneous operation by the user becomes high.

Accordingly, from the viewpoint of preventing such trouble, as shown in FIG. 25B, movement restricting member 805 is preferably provided for temporarily restricting the movement, in a pulling-out direction, of the sheet tray 802 at a position where the sheet tray 802 is pulled out of the apparatus body 801 and where the sheet feeding member 803 is accommodated in the apparatus body 801.

It should be noted that when the sheet feeding member 803 is to be pulled out of the apparatus body 801, it suffices if the sheet feeding member 803 may be pulled out after unlatching the movement restricting member 805.

DETAILED DESCRIPTION OF THE PREFERRED EMBODIMENTS

[Mode for Carrying Out the Invention]

Hereafter, detailed description will be given of the invention on the basis of the embodiments shown in the appended drawings.

(First Embodiment)

Figure 1:
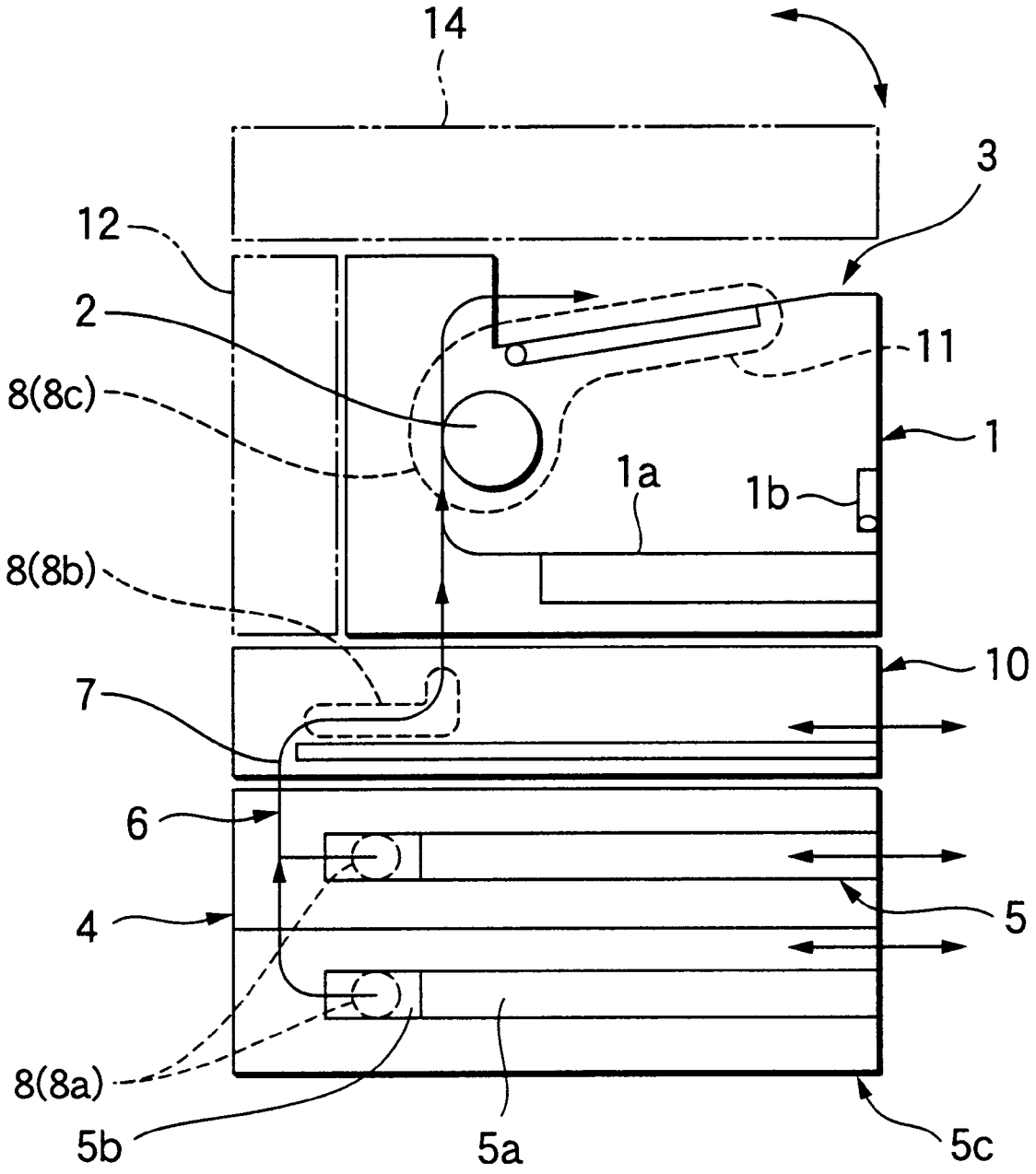
FIG. 1 is an explanatory diagram illustrating an outline of an image forming apparatus in accordance with the invention.
Figure 2:
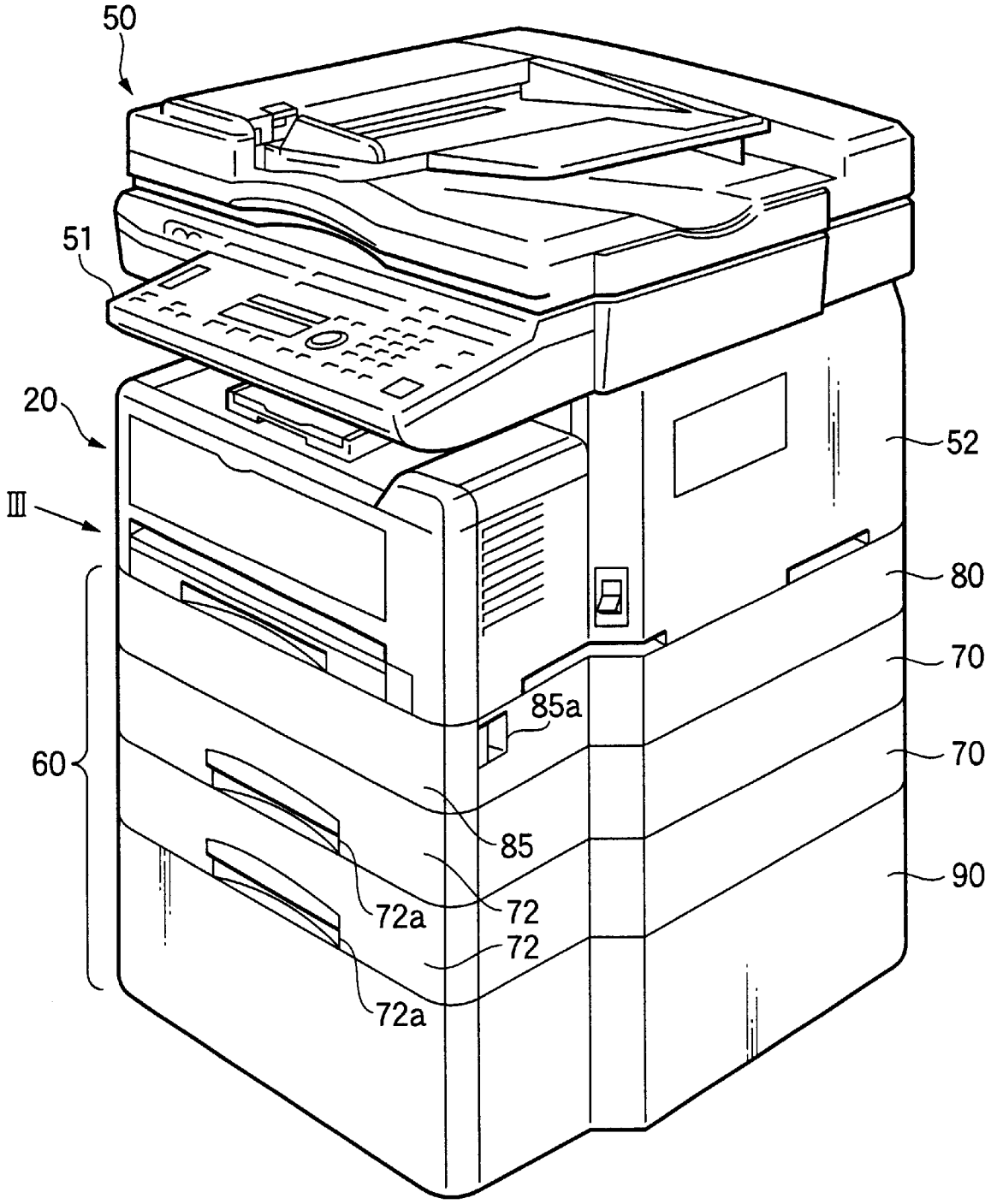
FIG. 2 is a perspective view illustrating the image forming apparatus in accordance with a first embodiment.
Figure 3:
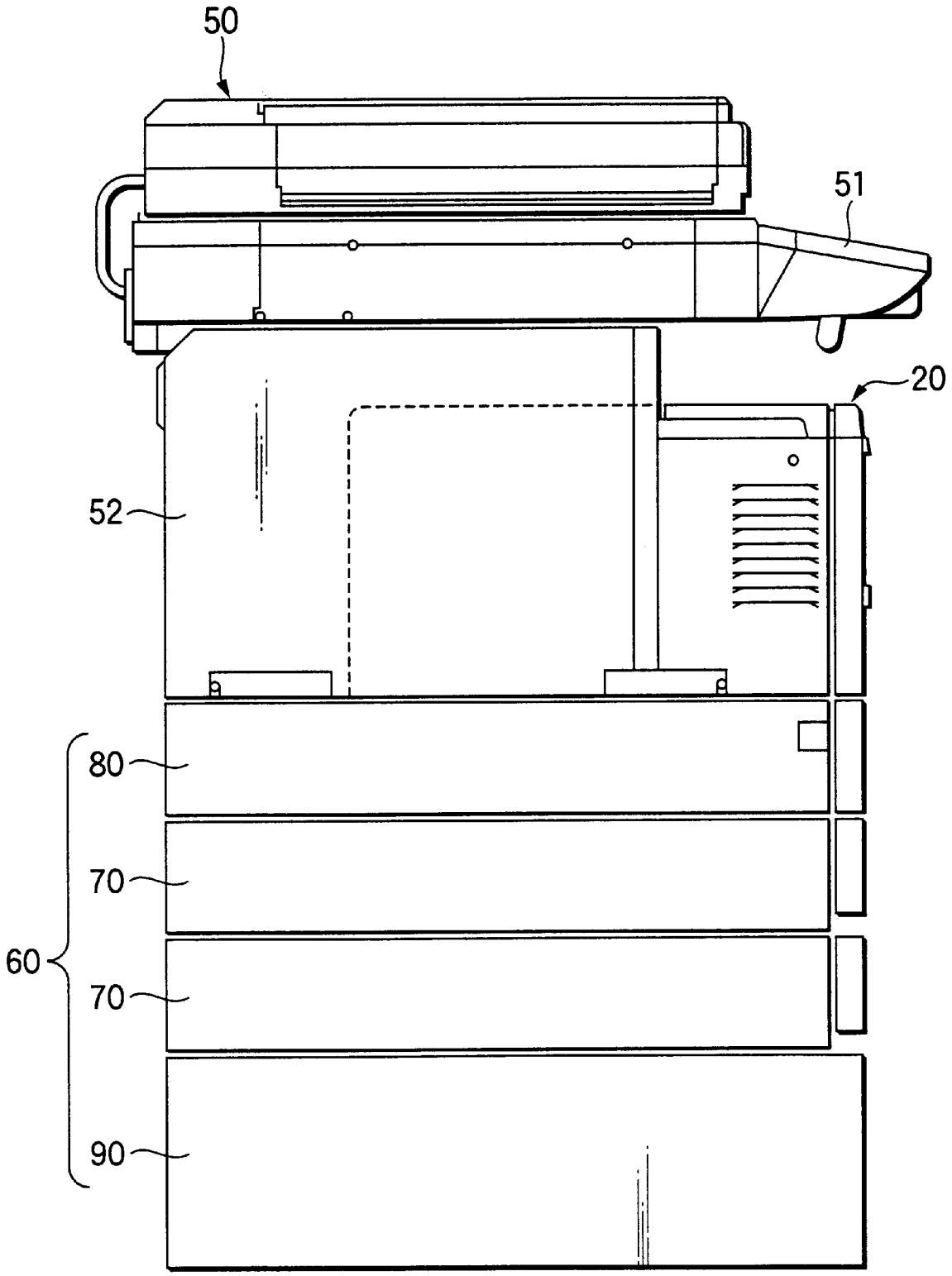
FIG. 3 is a view taken in the direction of arrow image reading unit in FIG. 2.
Figure 4:
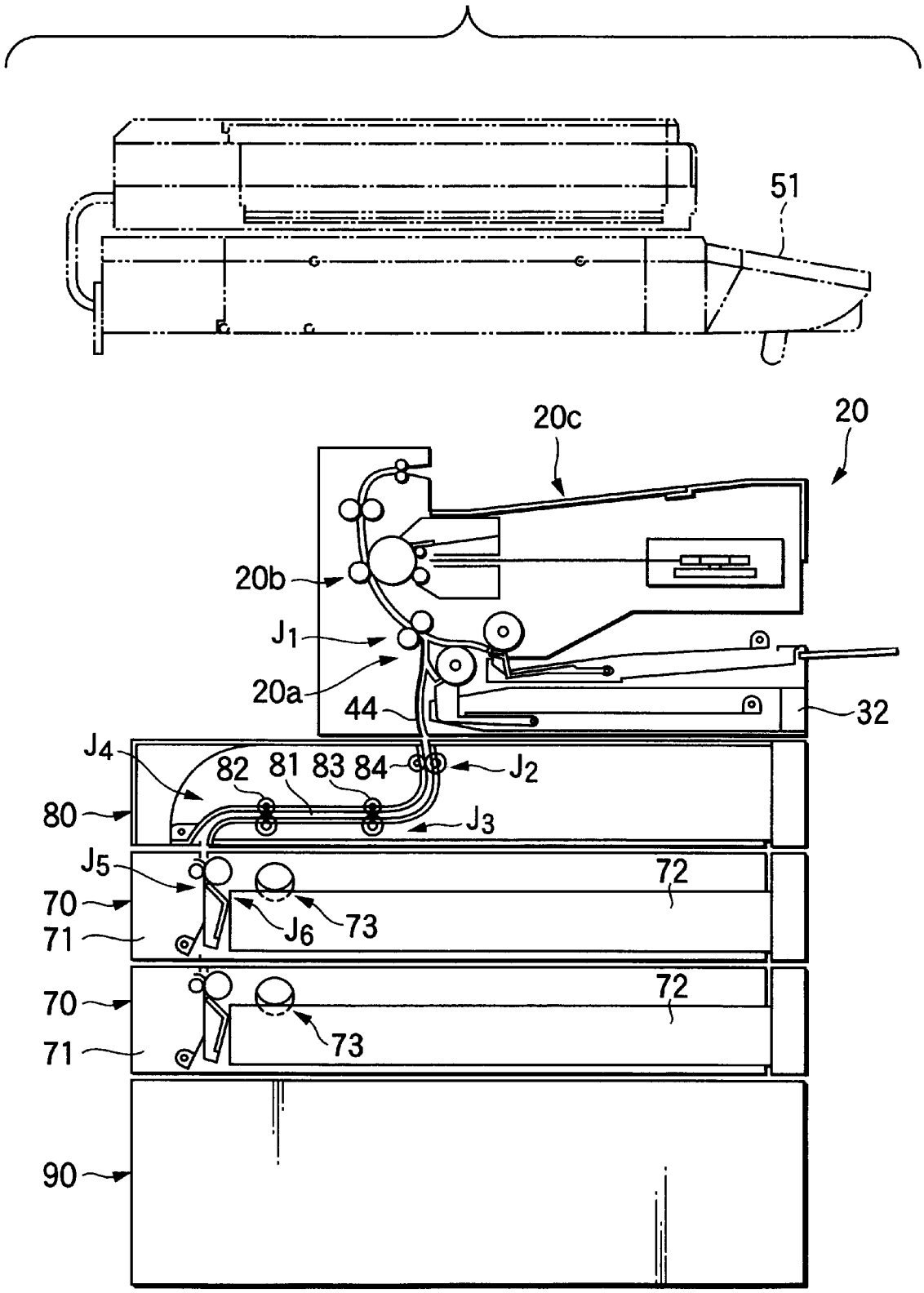
FIG. 4 is a side elevational view illustrating the image forming apparatus in accordance with the first embodiment.

FIGS. 2 to 4 are explanatory diagrams illustrating a first embodiment of an image forming apparatus to which the invention is applied.

This image forming apparatus is a so-called combination machine having the respective functions of a copying machine, a facsimile machine, a printer, and a scanner.

In the drawing, the image forming apparatus in accordance with this embodiment is provided with a printer unit 20 incorporating a process cartridge for image formation, an image reading unit 50 disposed on top of the printer unit 20, and paper feeding units 70 disposed below the printer unit 20 and adapted to feed paper serving as a recording material to the printer unit 20. Further, an operation panel 51 is provided on this side of the image reading unit 50.

It should be noted that, in FIGS. 2 to 4, reference numeral 90 denotes a stand which is disposed underneath the lowest paper feeding unit 70 for adjusting the height of the image forming apparatus.

In this embodiment, the printer unit 20 has a configuration similar to that adopted in, for example, a desk-top laser printer.

Figure 5:
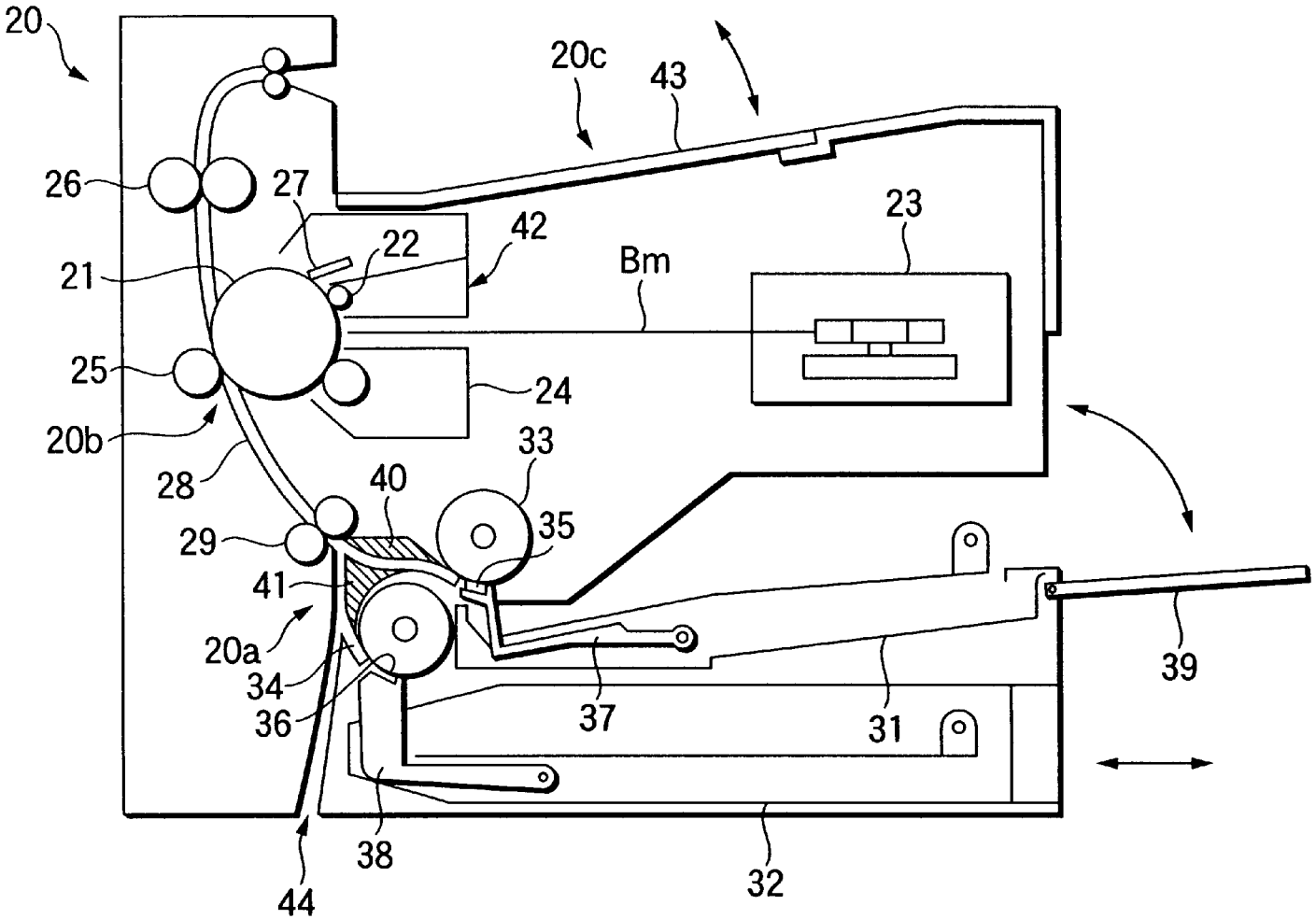
FIG. 5 is an explanatory cross-sectional view of a printer unit in accordance with the first embodiment.
Figure 6:
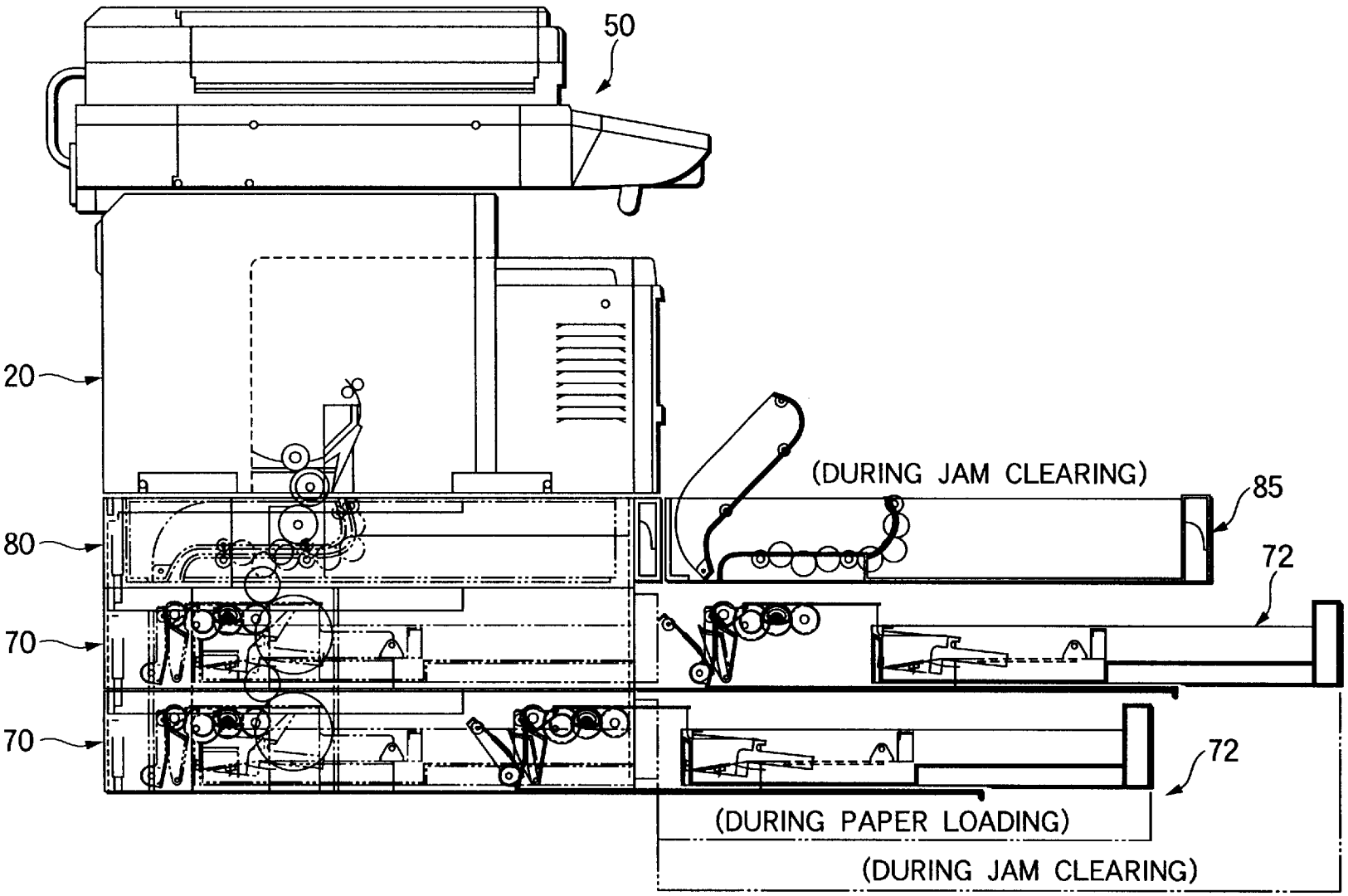
FIG. 6 is an explanatory diagram illustrating the state of operation of paper feeding units and an intermediate transport unit in accordance with the first embodiment.

In the drawing, as particularly shown in FIG. 5, the printer unit 20 has a paper feeding section 20*a* for feeding paper, an image forming section 20*b* for forming an image of the fed paper, and a discharge tray 20*c* onto which the paper after image formation is discharged.

Here, the image forming section 20*b* forms an image by using an electrophotographic process, and is comprised of a photoconductor drum 21; a charging unit 22 for electrostatically charging the surface of the photoconductor drum 21 uniformly; a latent-image writing unit 23 for forming an electrostatic latent image by radiating a laser beam Bm to the photoconductor drum 21 on the basis of image data; a developing unit 24 for making the latent image visible by selectively transferring a toner; a transfer unit 25 for transferring a toner image on the surface of the photoconductor drum 21 onto the paper (not shown) being fed along a paper transporting passage 28; a fixing unit 26 for fixing the toner image on the paper by heating and/or pressurizing the toner image; and a cleaning unit 27 for cleaning the toner remaining on the photoconductor drum 21 after transfer.

It should be noted that reference numeral 29 denotes a pair of registration rolls disposed on the upstream side of the paper transporting passage 28 and adapted to transport the paper fed out from the paper feeding section 20*a*, which will be described later, to a toner-image transferring position at a predetermined timing.

In addition, the paper feeding section 20*a* has two paper trays 31 and 32 disposed at upper and lower positions; paper feed rolls 33 and 34 for feeding out the paper from the upper or lower paper tray 31 or 32; paper separating members 35 and 36 which are respectively brought into pressure contact with the paper feed rolls 33 and 34; and holders 37 and 38 attached rotatably to the respective paper trays 31 and 32 to support the paper separating members 35 and 36.

Of the aforementioned paper trays 31 and 32, the paper tray 32 disposed on the lower side is detachable with respect to the printer unit 20, and can be pulled out toward this side as seen from the user operation side of the printer unit 20. Further, in this embodiment, when the paper tray 32 in which paper for the longitudinal feeding of the JIS standard A4 size is accommodated is loaded, the entire paper tray 32 is accommodated in the printer unit 20 (see FIG. 2).

On the other hand, the paper tray 31 on the upper side is used as a manual feeding tray, the paper of a desired size can be easily inserted from this side of the printer unit 20.

It should be noted that reference numeral 39 denotes a manual feed assisting tray provided openably on this side of the paper tray 31, and reference numerals 40 and 41 denote paper guides for guiding the paper fed out from the paper tray 31 or 32 toward the resist roll 29.

Further, in this printer unit 20, for the purpose of improvement of the maintenance features, the photoconductor drum 21 and its peripheral units including the charging unit 22, the developing unit 24, the cleaning unit 27, and the like are formed integrally as a process cartridge 42. If a top cover 43, a portion of which serves as the discharge tray 20*c*, is opened, this process cartridge 42 can be opened upwardly of the printer unit 20.

In the printer unit 20, since the process cartridge 42 is detachably arranged, not only can the replacement of the process cartridge 42 be facilitated, but in the event that a paper jam is occurred in the printer unit 20, the paper can be easily removed by detaching this process cartridge 42. Further, in the case where the process cartridge 42 is detached, since the paper guides 40 and 41 are disposed in such a manner as to be swingable about the axis of one of the resist rolls 29, it is possible to easily clear a jam occurring in that portion by moving these paper guides 40 and 41.

It should be noted that reference numeral 44 denotes a paper transporting passage which is provided on the innermost recess side of the paper tray 32 and along which the paper fed out from the paper feeding unit 70 is transported.

Here, in the image forming apparatus in accordance with this embodiment, to make it possible to accommodate paper larger than the paper accommodated in the paper tray 32 of the printer unit 20, the depth of the paper feeding units 70 is set to be larger than the depth of the printer unit 20.

Further, in this embodiment, the printer unit 20 is disposed in such a manner as to be offset on this side (on the operation panel 51 side) of the image forming apparatus, such that front faces of the printer unit 20 and the paper feeding units 70 are formed substantially flush.

It should be noted that a pair of supporting walls 52 for supporting the image reading unit 50 are respectively disposed on both side surfaces of the printer unit 20, so that a predetermined space is formed over the discharge tray 20*c* of the printer unit 20.

Next, referring to FIGS. 6 to 10, a description will be given of the paper feeding unit 70.

In this embodiment, as the paper feeding units 70, two paper feeding units are provided which are capable of accommodating paper larger than the paper accommodated in the paper tray 32 of the printer unit 20, e.g., paper of the JIS standard A3 size.

The paper feeding unit 70 has a housing 71, a paper feeding cassette 72 which can be pulled out of the housing 71 toward this side of the image forming apparatus, and a paper feeding mechanism 73 disposed in an upper portion of an inner recessed portion of the paper feeding cassette 72 in the inserting direction thereof and adapted to feed out the paper in the inserted paper feeding cassette 72 toward the printer unit 20 side.

Figure 7A:
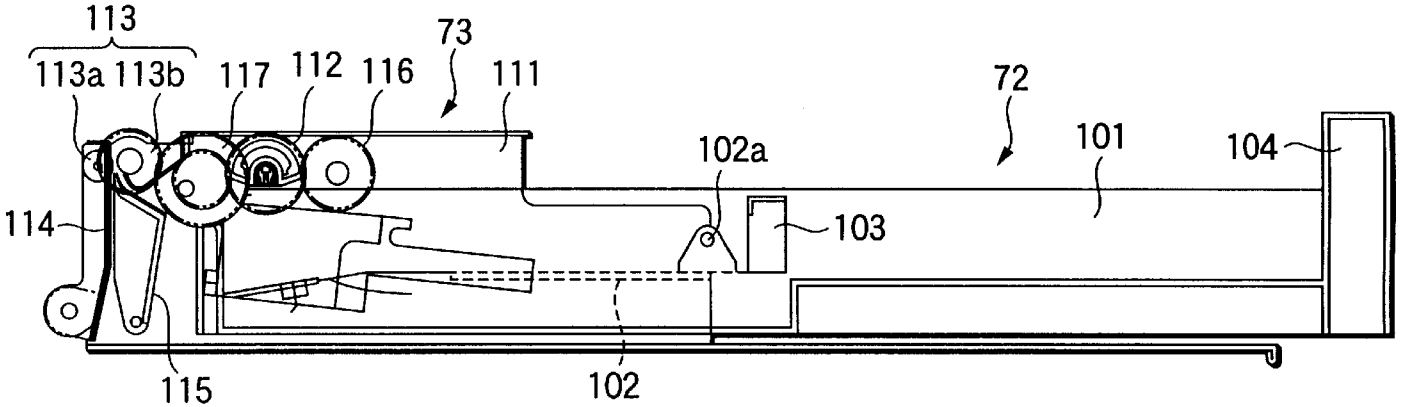
FIG. 7A is an explanatory diagram illustrating a contracted state of a paper feeding cassette used in the first embodiment.

FIG. 7A shows a state in which the paper feeding cassette 72 and the paper feeding mechanism 73 of the above-described paper feeding unit 70 is pulled out.

In the drawing, the paper feeding cassette 72 has a tray base 101, a bottom plate 102 disposed in such a manner as to extend from a substantially central portion of the paper feeding cassette 72 toward the innermost recess side, in the inserting direction, of the paper feeding cassette 72, and an end guide 103 for paper disposed in such a manner as to be movable from a substantially central portion of the paper feeding cassette 72 toward this side in the inserting direction. Further, the bottom plate is swingable about a shaft 102*a* provided in the substantially central portion of the paper feeding cassette 72, and is urged upward in the drawing by an unillustrated urging member such as a spring. Incidentally, reference numeral 104 denotes a lever for drawing out the paper feeding cassette 72.

Meanwhile, the paper feeding mechanism 73 has a paper-feeding-mechanism base 111, a semicircular feed roll 112 for paying out the sheet (not shown) placed in the paper feeding cassette 72, a pair of transport rolls 113 (113*a*, 113*b*) for transporting the paper paid out, and an outer chute 114 and an inner chute 115 for guiding the paper being transported.

In addition, corner separators 105 (see FIG. 7B) are respectively provided at both ends on the innermost recess side, in the inserting direction, of the paper feeding cassette 72, and are adapted to feed out one sheet at a time the paper paid out by the feed roll 112.

It should be noted that reference numerals 116 and 117 denote gears for transmitting the driving force to the feed roll 112 and the transport roll 113*b*, respectively.

Figure 8:
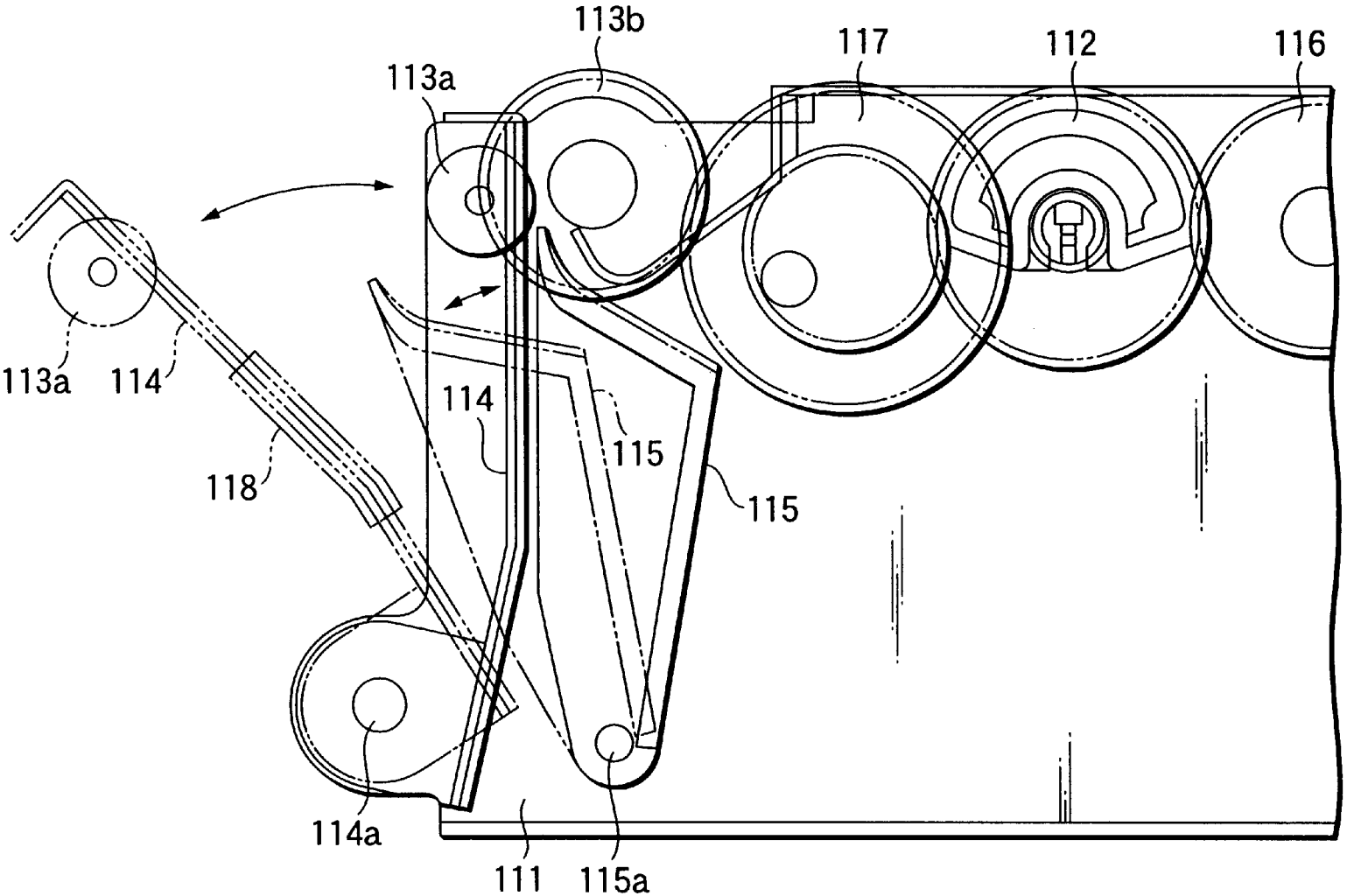
FIG. 8 is an explanatory diagram illustrating a paper nipping mechanism of the paper feeding cassette used in the first embodiment.

As shown in FIG. 8, the outer chute 114 is rotatable about a shaft 114*a* provided at a lower end of the paper-feeding-mechanism base 111, and the transport roll 113*a* is attached to a distal end portion of its free end. Further, this outer chute 114 is urged toward the feed roll 112 side by an unillustrated urging member such as a spring, and is normally positioned at the position indicated by the solid lines in the drawing.

Meanwhile, the inner chute 115 is also rotatable about a shaft 115*a* provided at a lower side of the paper-feeding-mechanism base 111. This inner chute 115 is normally positioned at the position indicated by the solid lines in the drawing by the urging force for the outer chute 114.

In addition, a paper nipping lever 118 is provided at a substantially central portion in the axial direction of the outer chute 114.

This paper nipping lever 118 has a curved surface substantially similar to that of the outer chute 114, and is urged toward the feed roll 112 by an unillustrated torsion spring. Further, when the paper feeding mechanism 73 is accommodated on the innermost recess side, the rear surface of the paper nipping lever 118 is pressed by an unillustrated projection provided in the housing 71 and is thus formed substantially flush with the outer chute 114, thereby assuming a state in which the paper transporting passage is not blocked. On the other hand, when the paper feeding mechanism 73 is pulled out of the housing 71, the pressing by the unillustrated projection is canceled, thereby assuming a state in which the paper transporting passage is blocked by the urging force of the unillustrated torsion spring.

Figure 9C:
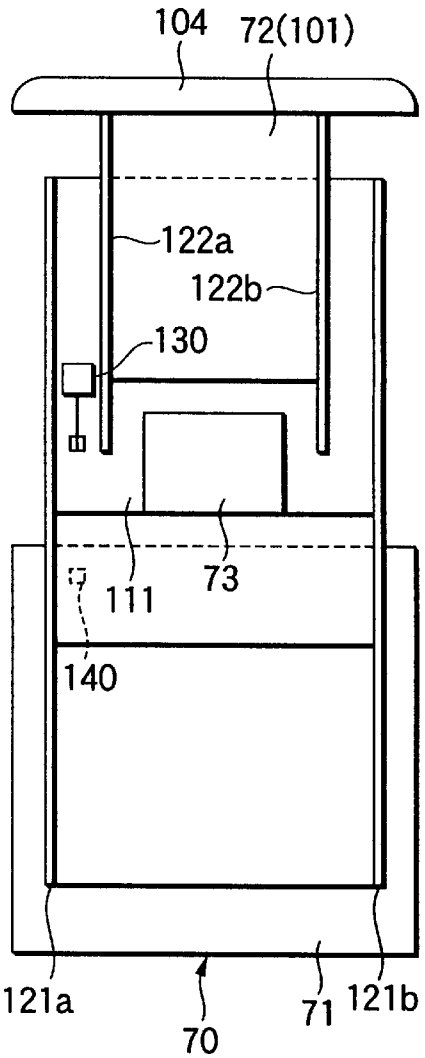
FIGS. 9A to 9C are explanatory diagrams illustrating the process of the operation of pulling out the paper feeding cassette of the paper feeding unit.
Figure 9B:
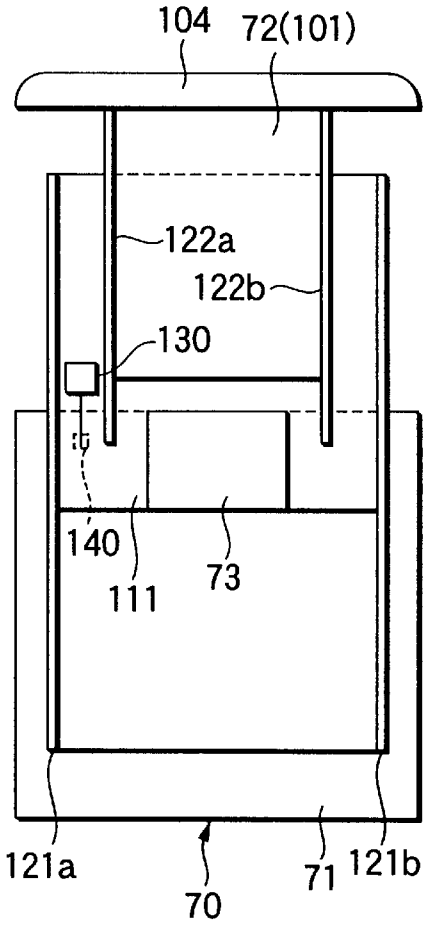
Figure 9A:
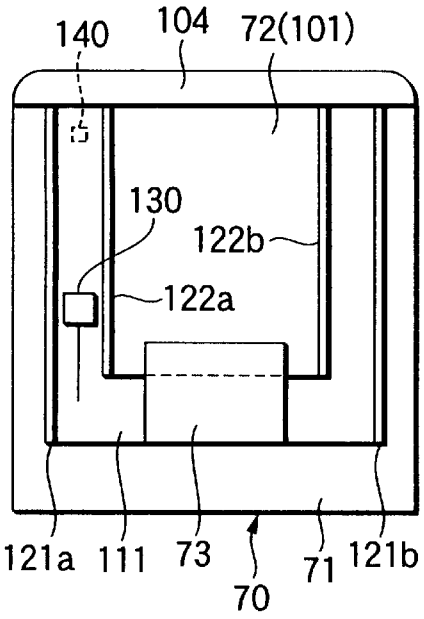

In addition, as schematically shown in FIGS. 9A to 9C, in the paper feeding unit 70 in accordance with this embodiment, the paper-feeding-mechanism base 111 of the paper feeding mechanism 73 is supported slidably with respect to the housing 71 by means of outer rails 121 (121*a*, 121*b*). Further, the tray base 101 of the paper feeding unit 72 is supported slidably with respect to the paper-feeding-mechanism base 111 by means of inner rails 122 (122*a*, 122*b*).

Consequently, with the paper feeding unit 70 in accordance with this embodiment, not only can the paper feeding cassette 72 be pulled out from this side of the housing 71, but the paper feeding mechanism 73 can be also pulled out from this side of the housing 71.

On the paper-feeding-mechanism base 111, a temporary stop mechanism 130 for temporarily stopping the drawing out of the paper feeding mechanism 73 is provided at a portion positioned between the outer rail 121*a* and the inner rail 122*a*.

Figure 10A:
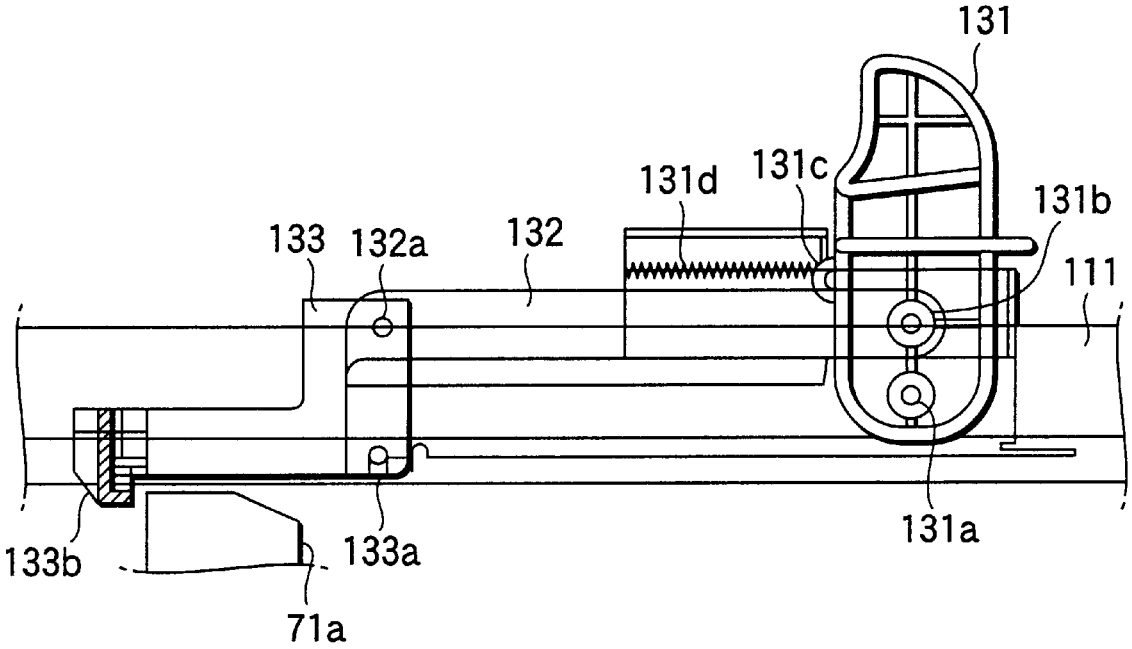
FIGS. 10A and 10B are explanatory diagram illustrating a temporary stop mechanism of the paper feeding cassette used in the first embodiment.

As shown in FIG. 10A, this temporary stop mechanism 130 has a lever 131 which swings about a shaft 131*a* provided on the paper-feeding-mechanism base 111, an I-shaped first arm 132 linked to a shaft 131*b* provided above the shaft 131*a*, and an L-shaped second arm 133 linked to a shaft 132*a* provided at the other end of the first arm 132. This second arm 133 is swingable about a shaft 133*a* provided on the paper-feeding-mechanism base 111, and a hook 133*b* having an inclined surface at one end thereof and a vertical surface at the other end thereof is provided at its free end portion.

The lever 131 is loaded with a spring 131*d* at a hole 131*c*, so that the lever 131 is normally adapted to be urged leftward in the drawing.

Meanwhile, as shown in FIGS. 9 and 10, of the bottom surface of the housing 71, a projection 71*a* with which the hook 133*b* is engaged is formed on a portion located on this side in the inserting direction of the paper feeding cassette 72.

This projection 71*a* is so arranged that, in correspondence with the hook 133*b*, a vertical surface is formed at one end thereof, and an inclined surface is formed at the other end thereof, such that the corresponding vertical surfaces and the corresponding inclined surfaces of the hook 133*b* and the projection 71*a* are opposed to each other.

In this embodiment, as is apparent from FIG. 4, the position where the paper is discharged from the paper feeding unit 70 and the position of the paper transporting passage 44 of the printer unit 20 (the position where the paper is carried in) are offset from each other, an intermediate transport unit 80 is provided for aligning these paper transporting passages.

Referring to FIGS. 4, 6, 13, and 14, a description will be given of the intermediate transport unit 80.

In this intermediate transport unit 80, a substantially S-shaped paper transporting passage 81 is formed for transporting the paper from the paper feeding unit 70 to the printer unit 20. Pairs of transport rolls 82 to 84 are arranged along this paper transporting passage 81 consecutively in that order from the upstream side in the transporting direction.

Figure 13:
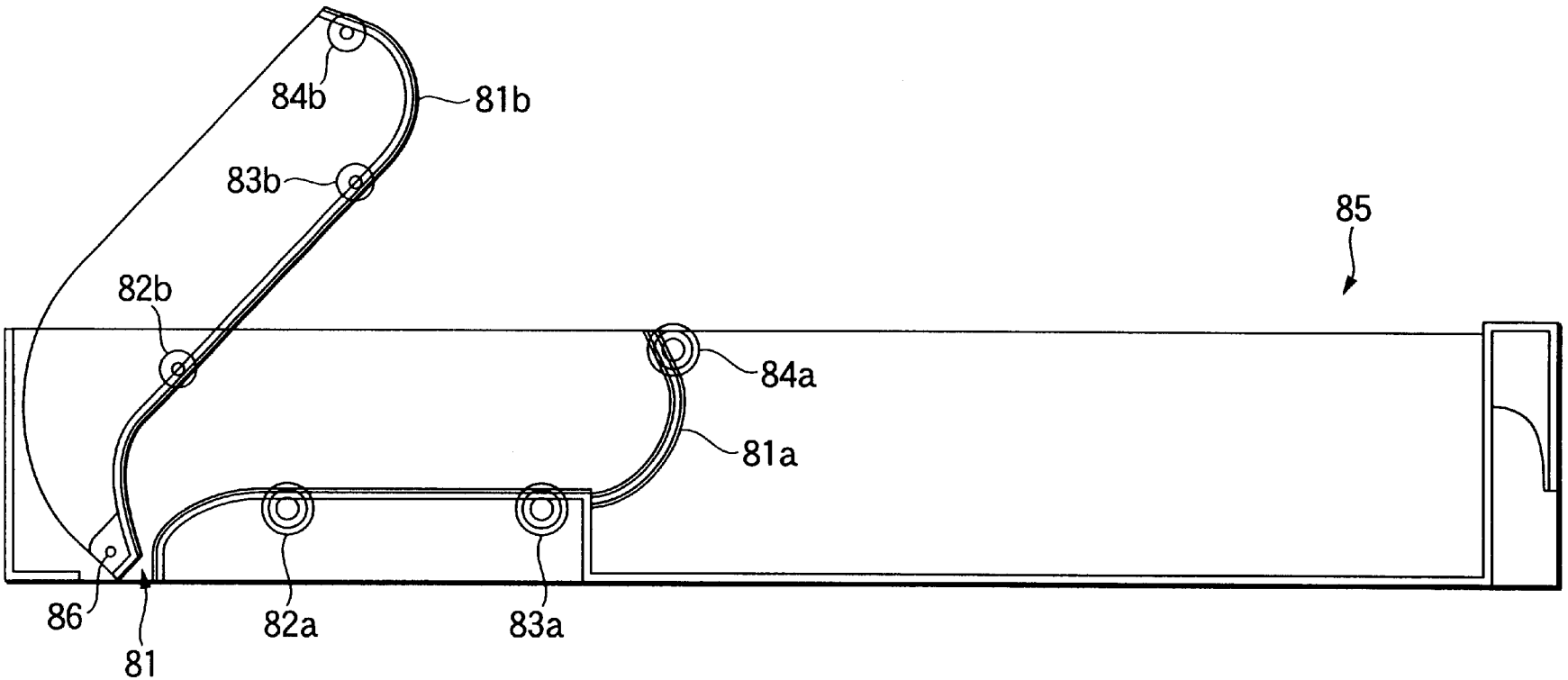
FIG. 13 is an explanatory diagram illustrating an intermediate transport unit in accordance with the embodiment.

FIG. 13 shows an intermediate transport tray 85 which is pulled out of the intermediate transport unit 80.

In this embodiment, of wall surfaces 81*a* and 81*b* making up the paper transporting passage 81, the lower wall surface 81*a* is fixedly disposed on the intermediate transport tray 85, and drive rolls 82*a* to 84*a* of the pairs of transport rolls 82 to 84 are disposed there.

On the other hand, the upper wall surface 81*b* is formed as an intermediate tray cover which is rotatable about a shaft 86 provided on the most upstream side, and driven rolls 82*b* to 84*b* of the pairs of transport rolls 82 to 84 are disposed there.

Figure 14A:
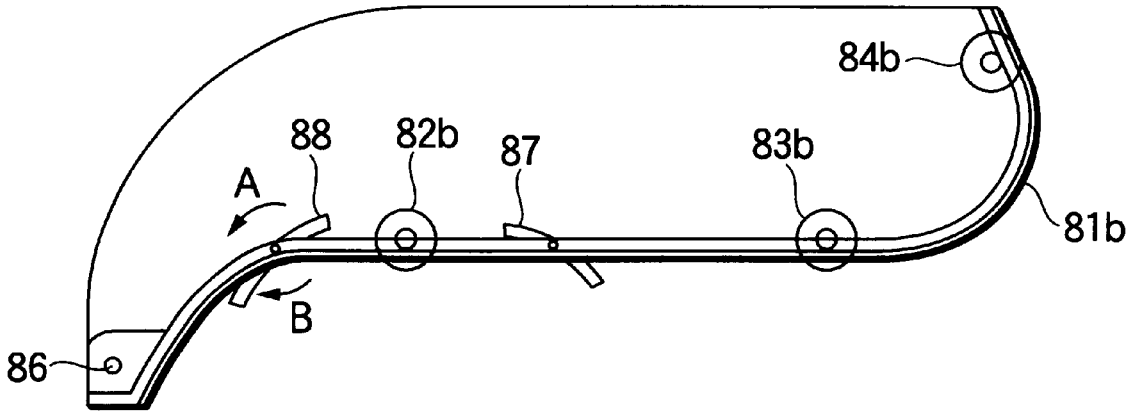
FIG. 14A is a side elevational view of an intermediate tray cover.
Figure 14B:
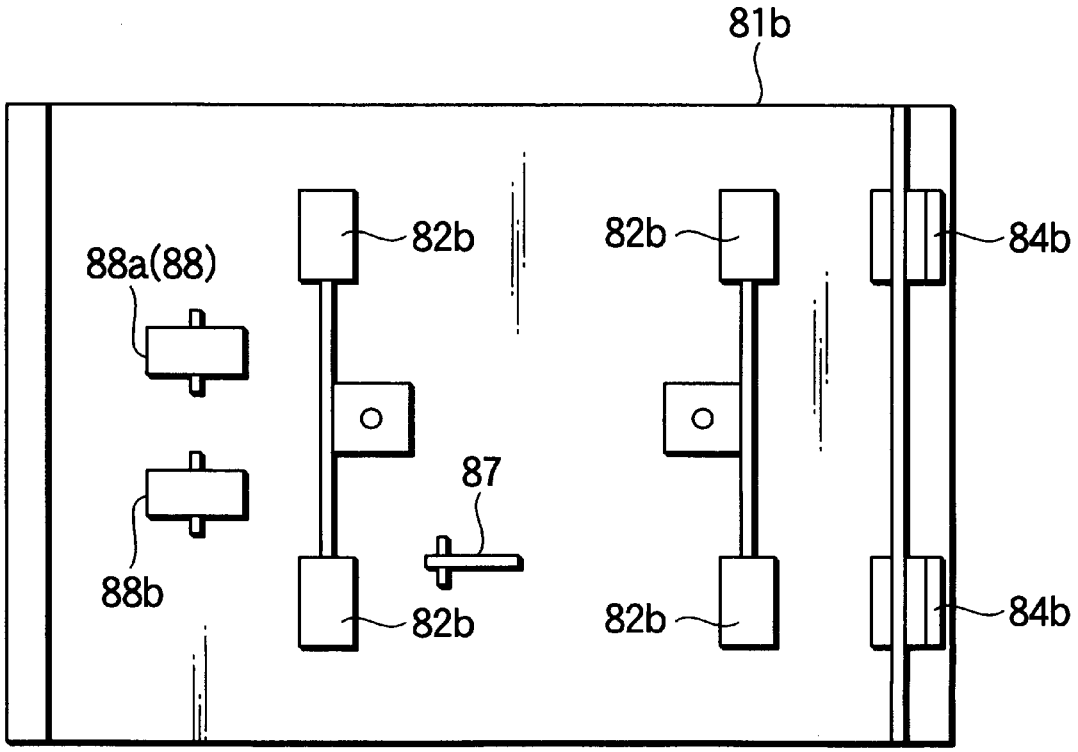
FIG. 14B is a top view thereof.

Further, as shown in FIGS. 14A and 14B, an actuator 87 which is urged downward in FIG. 14A by a predetermined spring force is provided on this side of a substantially central portion of the intermediate tray cover 81*b*. An unillustrated photosensor is disposed at one end of an arm of this actuator 87, thereby making it possible to detect the passage or a jam of the paper.

In addition, paper nipping levers 88 (88*a*, 88*b*) are provided on a further upstream side, in the paper transporting direction, of the driven roll 82*b* of the intermediate tray cover 81*b*.

These paper nipping levers 88 have curved surfaces substantially similar to that of the intermediate tray cover 81*b*, and are urged in the direction of arrow A in the drawing by unillustrated torsion springs, respectively. Further, when the intermediate transport tray 85 is accommodated in the intermediate transport unit 80, the upper sides of the paper nipping levers 88 are pressed by unillustrated projections provided in the intermediate transport unit 80, and a surface substantially flush with the surface of the intermediate tray cover 81*b* is formed to assume a state in which the paper transporting passage 81 is not blocked. On the other hand, when the intermediate transport tray 85 is pulled out of the intermediate transport unit 80, the pressing by the unillustrated projections is canceled to assume a state in which the paper transporting passage 81 is blocked by the urging force of the unillustrated torsion springs.

Figure 17A:
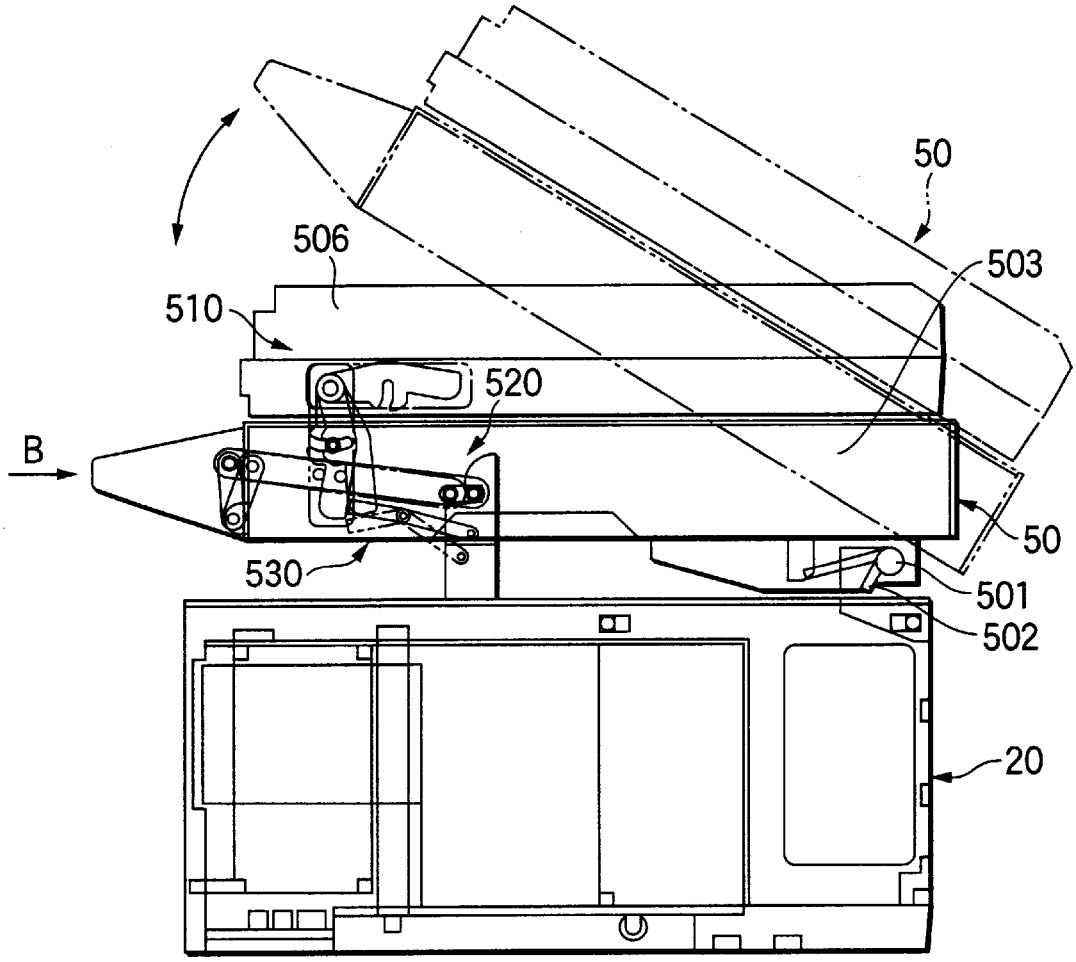
FIG. 17A is an explanatory side elevational view illustrating an image reading unit in accordance with the first embodiment.
Figure 17B:
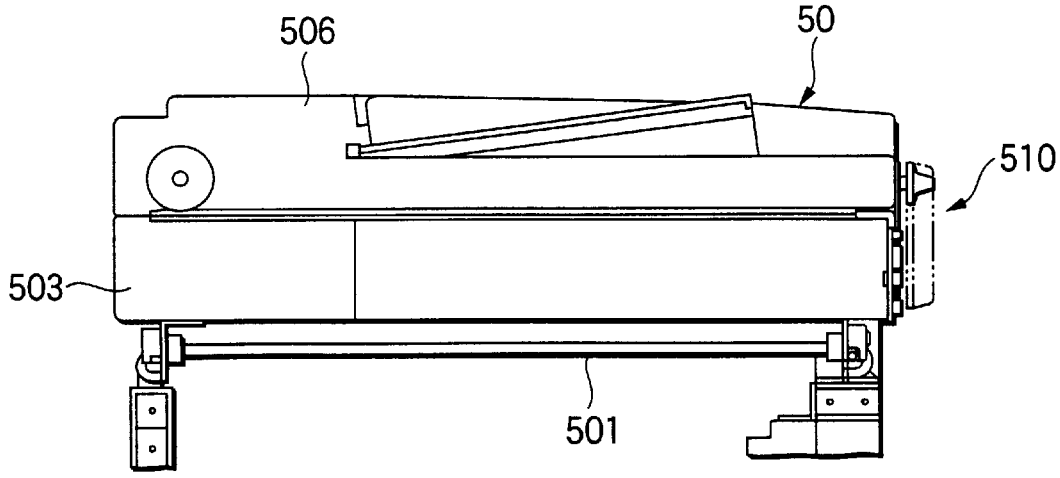
FIG. 17B is a view taken in the direction of arrow B in FIG. 17A.

In addition, in this embodiment, as shown in FIGS. 4, 17A, and 17B, the image reading unit 50 is disposed in such a manner as to be spaced apart from the discharge tray 20*c* in a state in which a space (space for paper removal) which is open on this side is provided between the image reading unit 50 and the discharge tray 20*c*. The image reading unit 50 is supported on top of the printer unit 20 so as to be rotatably by means of a pivotally supporting shaft 501, and is pressed and urged toward the printer unit 20 by means of an urging spring 502 such as a torsion spring.

The image reading unit 50 has an original placing table 503 in which a scanner (not shown) for image reading is incorporated and has a platen (not shown) on which an original document is placed, as well as a platen cover 506 which is rotatably supported on the original placing table 503 so as to be rotatable about a pivotally supporting shaft (not shown) and in which an automatic document feeder is incorporated. Between the original placing table 503 and the platen cover 506, a latch mechanism 510 for engaging or disengaging them is provided. Further, a lock mechanism 520 for fixing the image reading unit 50 at a predetermined position is provided between the image reading unit 50 and the printer unit 20.

Figure 18:
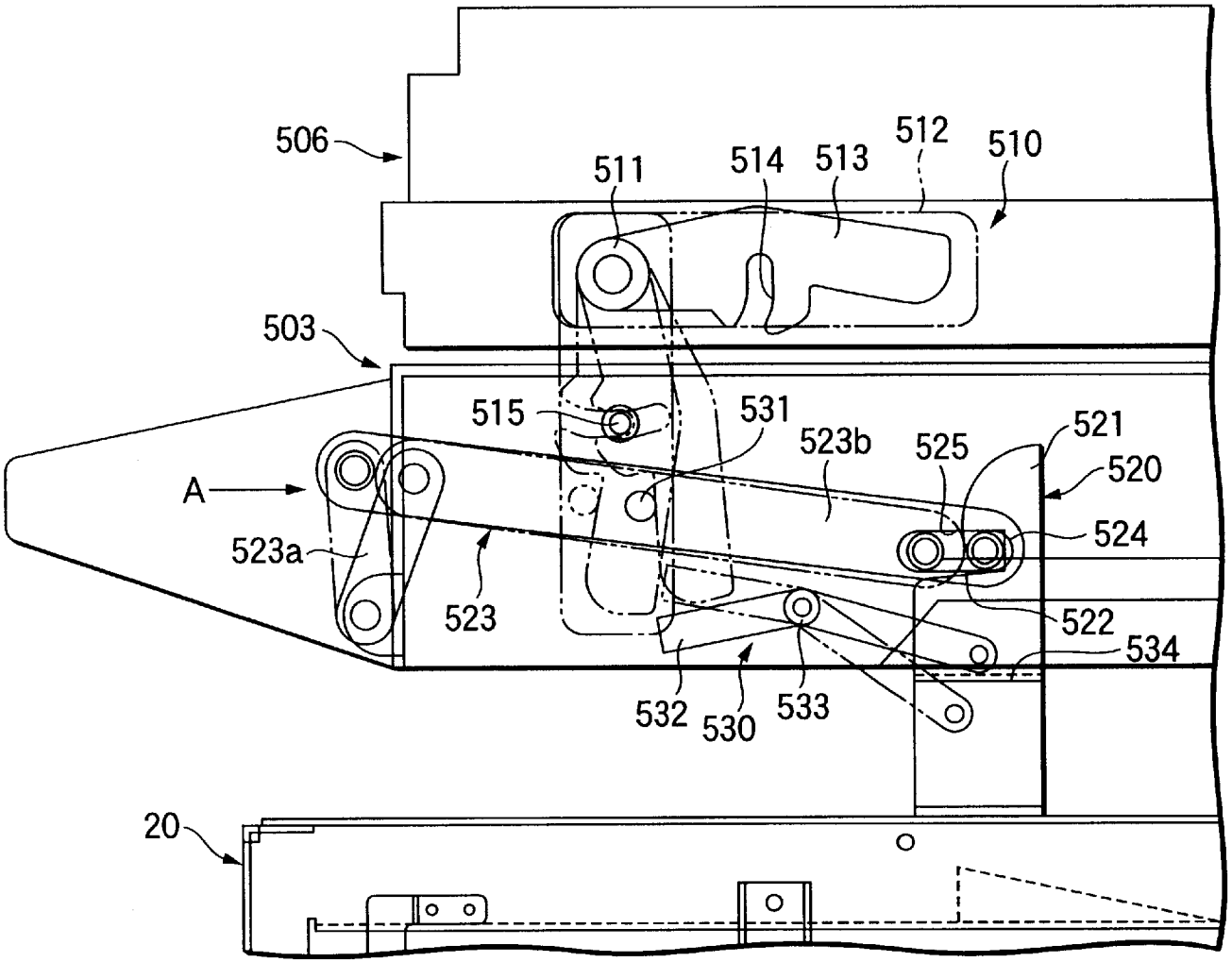
FIG. 18 is an explanatory view illustrating the details of a latch mechanism provided in the image reading unit.
Figure 19:
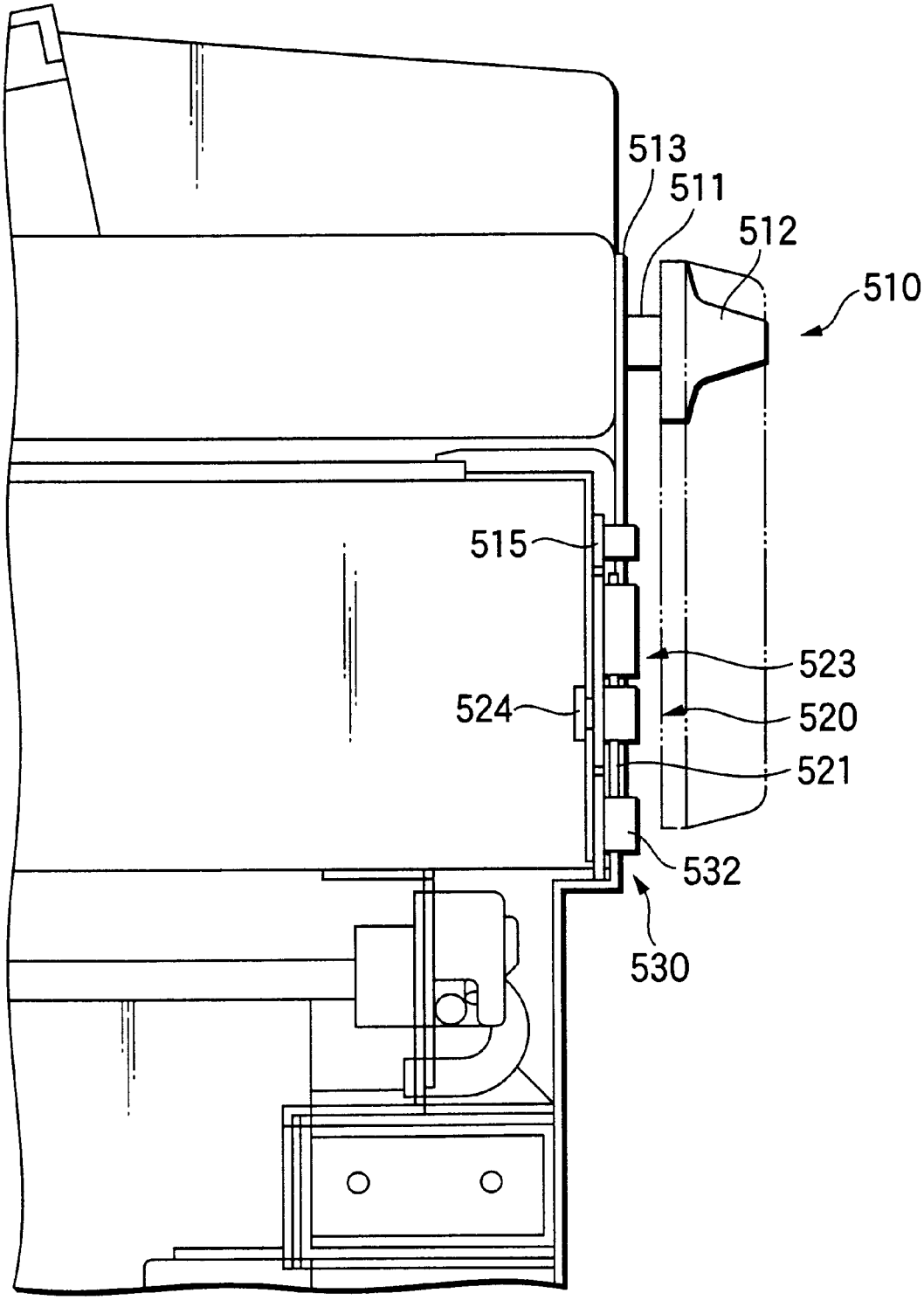
FIG. 19 is a view taken in the direction of arrow A in FIG. 19.

In this embodiment, as particularly shown in FIGS. 18 and 19, the latch mechanism 510 is arranged such that a latch lever 512 is provided on one side portion of the platen cover 506 so as to be rotatable about a pivotally supporting shaft 511, a lock lever 513 is secured coaxially with the latch lever 512, and a substantially U-shaped retaining slot which is open in a clockwise direction is formed in the lock lever 513, while a lock pin 515 for engaging with or disengaging from the retaining slot 514 in the lock lever 513 is projectingly provided in a fixed manner on one side portion of the original placing table 503.

Further, as shown in FIGS. 18 and 19, the lock mechanism 520 is arranged such that a projecting lock piece 521 is projectingly provided on the printer unit 20 side, a substantially U-shaped retaining slot 522 which is open in a horizontal direction is provided in the projecting lock piece 521, while a link mechanism 523 using two link arms 523*a* and 523*b* is provided on the original placing table 50 side. A lock pin 524 is projectingly formed at a distal end of one link arm 523*b* of the link mechanism 523, and the lock pin 524 is slidably engaged in an elongated hole 525 formed in one portion, e.g., a frame, of the original placing table 503 in such a manner as to extend horizontally, thereby allowing the lock pin 524 and the retaining slot 522 in the projecting lock piece 521 to engage with or disengage from each other.

Furthermore, in this embodiment, an interlocking mechanism 530 for interlocking the latch mechanism 510 and the lock mechanism 520 is provided between these two mechanisms.

This interlocking mechanism 530 is arranged such hat an actuating pin 531 is projectingly provided at an intermediate portion of one link arm 523*b* of the aforementioned lock mechanism 520, the latch lever 512 of the latch mechanism 510 is made to abut against this actuating pin 531, a bent portion of a stopper arm 532 bent, for instance, in a boomerang shape is pivotally supported on one side portion of the original placing table 503, and this stopper arm 532 is urged clockwise in FIG. 18 by an urging spring 533 such as a torsion spring. Meanwhile, a stopper unlatching wall 534 is provided on the printer unit 20 in correspondence with one end portion of the stopper arm 532. The arrangement provided is such that when the stopper arm 532 is in a state of noncontact with the stopper unlatching wall 534, the other end portion of the stopper arm 532 is made to abut against the latch lever 512, thereby restricting the counterclockwise rotation, in FIG. 18, of the latch lever 512.

Namely, since the above-described latch mechanism 510, lock mechanism 520, and interlocking mechanism 530 are used in this embodiment, in the case where the image reading unit 50 is fixedly arranged in the horizontal attitude, it suffices if the latch lever 512 is pressed down and rotated until it abuts against the actuating pin 531 on the lower side, as particularly shown in FIGS. 18 and 19.

At this time, when one end portion of the stopper arm 532 of the interlocking mechanism 530 abuts against the stopper unlatching wall 534, the latch lever 512 is in a state in which the restriction of its counterclockwise rotation by the stopper arm 532 is canceled.

Then, the link mechanism 523 of the lock mechanism 520 is operable, so that the lock pin 524 which is constrained by the link mechanism 523 is engaged with the retaining slot 522 in the projecting lock piece 521, thereby locking the image reading unit 50.

As for the lock lever 513 of the latch mechanism 510, on the other hand, in the state in which the platen is closed by the platen cover 506, the lock pin 515 is in a state of being engaged in the retaining slot 514 in the lock lever 513. If the platen cover 506 is opened, however, the lock lever 513 is moved by following the movement of the platen cover 506, and the lock pin 515 is naturally disengaged from the retaining slot 514 in the lock lever 513, so that no hindrance is caused to the opening operation of the platen cover 506.

In addition, as will be described later, it becomes necessary to upwardly rotate the image reading unit 50 when the clearing of a jam is performed inside the printer unit 20, but if an attempt is made to open the image reading unit 50, the lock pin 524 of the lock mechanism 520 becomes disengaged from the retaining slot 522 in the projecting lock piece 521, with the result that the position of the actuating pin 531 becomes offset.

Then, when the stopper arm 532 of the interlocking mechanism 530 moves away from the stopper unlatching wall 534, the stopper arm 532 reaches a position for restricting the counterclockwise rotation of the lock lever 513 of the latch mechanism 510.

In this state, the lock lever 513 of the latch mechanism 510 does not rotate counterclockwise due to the presence of the stopper arm 532, and the locked state of the lock pin 515 and the retaining slot 514 in the lock lever 513 is maintained, so that the platen cover 506 is fixed to the original placing table 503.

For this reason, when the image reading unit 50 is opened about the pivotally supporting shaft 501, there is no possibility that the platen cover 506 moves away from the original placing table 503 and rotates unnecessarily.

Next, a description will be given of an image forming process of the image forming apparatus in accordance with this embodiment.

When the pressing down of a copy button, reception by facsimile, or reception of a print signal is effected, a predetermined image forming process is executed.

Specifically speaking, when copying, for example, is effected, the original is read by the image reading unit 50, its read signal is converted into a digital image signal by an unillustrated image signal processor and is temporarily stored in an unillustrated memory, and a toner image is formed on the basis of this digital image signal.

Namely, by means of the latent-image writing unit 23 an electrostatic latent image is written on the photoconductor drum 21 which is electrostatically charged uniformly by the charging unit 22 in response to the digital image signal inputted from the image signal processor.

Then, the electrostatic latent image thus formed is subjected to development to form a toner image.

On the other hand, the paper is transported at a predetermined timing to a transfer position where the photoconductor drum 21 and the transfer unit 25 are opposed to each other.

At the transfer position, the toner image carried on the photoconductor drum 21 is transferred onto the paper by the action of a transfer electric field formed between the photoconductor drum 21 and the transfer unit 25. The paper with the toner image transferred onto it is transported to the fixing unit 26 to undergo fixation, and is discharged onto the discharge tray 20*c* from the innermost recess side of the apparatus.

On the other hand, after the transfer, the toner remaining on the photoconductor drum 21 is cleaned by the cleaning unit 27.

In addition, in a case where, for example, paper of the JIS standard A4 size is required as the paper, the paper is supplied from the paper tray 32 of the printer unit 20.

In contrast, in a case where, for example, paper of a size larger than the JIS standard A size, e.g., paper of the JIS standard B4 size or the JIS standard A3 size, is required as the paper, the paper is supplied from the paper feeding cassette 72 of the paper feeding unit 70.

At this time, in this embodiment, since the intermediate transport unit 80 is disposed between the printer unit 20 and the paper feeding unit 70 to align their paper transporting passages, the paper is transported smoothly.

In addition, since the size of the paper feeding unit 70 can be made large, it is possible to prevent a situation in which the paper feeding cassette 72 projects toward the user side (the front side of the apparatus), and the front surfaces of the image forming apparatus can be made substantially flush. As a result, the discharge tray 20*c* of the printer unit 20 can be disposed on the side close to the user.

Next, a description will be given of the process of loading the paper and the process of clearing a jam in the paper feeding unit 70 in accordance with this embodiment.

Process of Loading the Paper in the Paper Feeding Unit

Figure 11:
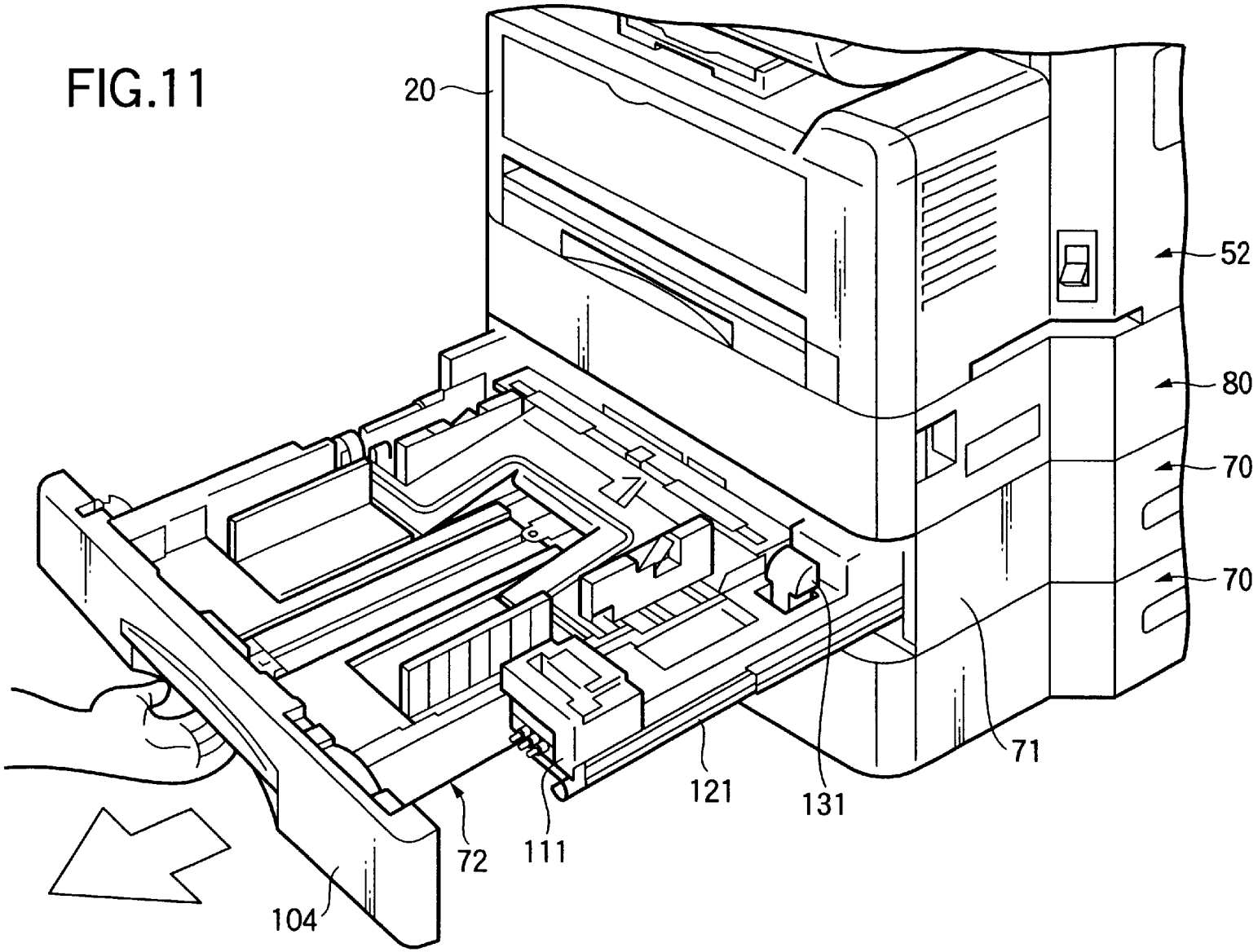
FIG. 11 is a schematic diagram illustrating the process of loading paper in the paper feeding unit.

When the paper is loaded in the paper feeding unit 70, the user first pulls out the lever 104 of the paper feeding cassette 72 toward this side of the apparatus, as shown in FIG. 11.

At this time, in the paper feeding unit 70, the paper feeding cassette 72 is drawn out while sliding on the inner rails 122 in conjunction with the drawing out of the lever 104, and when the inner rails 122 is fully extended, the paper-feeding-mechanism base 111 (and the paper feeding mechanism 73) is drawn out while sliding on the outer rails 121 in the form of being pulled by the paper feeding cassette 72. Then, when the hook 133*b* of the temporary stop mechanism 130 provided on the paper-feeding-mechanism base 111 abuts against the projection 71*a*, the drawing out of the paper feeding cassette 72 and the paper feeding mechanism 73 is stopped.

Figure 7B:
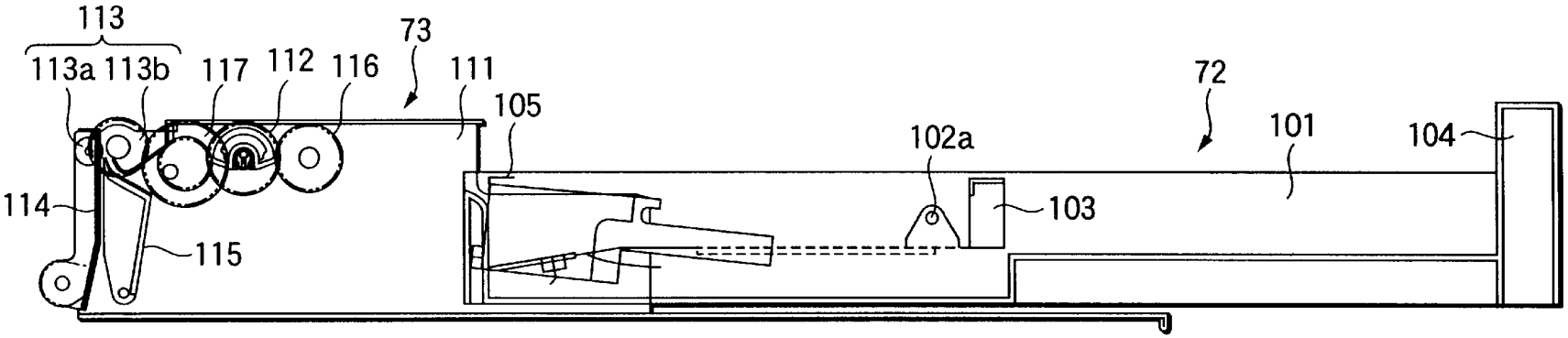
FIG. 7B is an explanatory diagram illustrating an extended state of the paper feeding cassette.

At this time, the positional relationship between the paper feeding cassette 72 and the paper feeding mechanism 73 which is drawn out is set in the state shown in FIGS. 7B and 9B, i.e., in the state in which the feed roll 112 (see FIG. 7A) located above the paper feeding cassette 72 during paper feeding is disposed on the innermost recess side relative to the paper feeding cassette 72 during drawing out.

Accordingly, as shown in FIGS. 9B and 11, nothing blocks the paper feeding cassette 72 which is exposed to the outside of the housing 71, so that the insertion of new paper is facilitated.

In addition, when only the loading of the paper is effected, since the entire paper feeding mechanism 73 is not drawn out by virtue of the temporary stop mechanism 130, the length which is drawn out is made compact correspondingly.

Clearing of a Jam in the Paper Feeding Unit

Next, a description will be given of a method of clearing a paper jam occurring in the paper feeding unit 70 in accordance with this embodiment.

In the paper feeding unit 70 and its vicinity, jams are likely to occur at the portions indicated at J5 and J6 in FIG. 4, for instance, and also in a case where the jammed paper inside the paper feeding unit 70 is removed, the user first pulls out the lever 104 of the paper feeding cassette 72 toward this side of the apparatus, as shown in FIG. 11.

At this time, in the paper feeding unit 70, as shown in FIGS. 9A, 9B, and 9C, the paper feeding cassette 72 is first drawn out while sliding on the inner rails 122 in conjunction with the drawing out of the lever 104. Then, when the inner rails 122 is fully extended, the paper-feeding-mechanism base 111 (and the paper feeding mechanism 73) is drawn out while sliding on the outer rails 121 in the form of being pulled by the paper feeding cassette 72.

At this time, in conjunction with the drawing out of the paper-feeding-mechanism base 111, the pressing of the paper nipping lever 118 is canceled and is tilted toward the paper transporting passage side, so that the paper which is jammed in the paper transporting passage is forcibly nipped.

Further, when the hook 133*b* of the temporary stop mechanism 130 provided on the paper-feeding-mechanism base 111 abuts against the projection 71*a* of the housing 71, the drawing out of the paper feeding cassette 72 and the paper feeding mechanism 73 is temporarily stopped.

Figure 12:
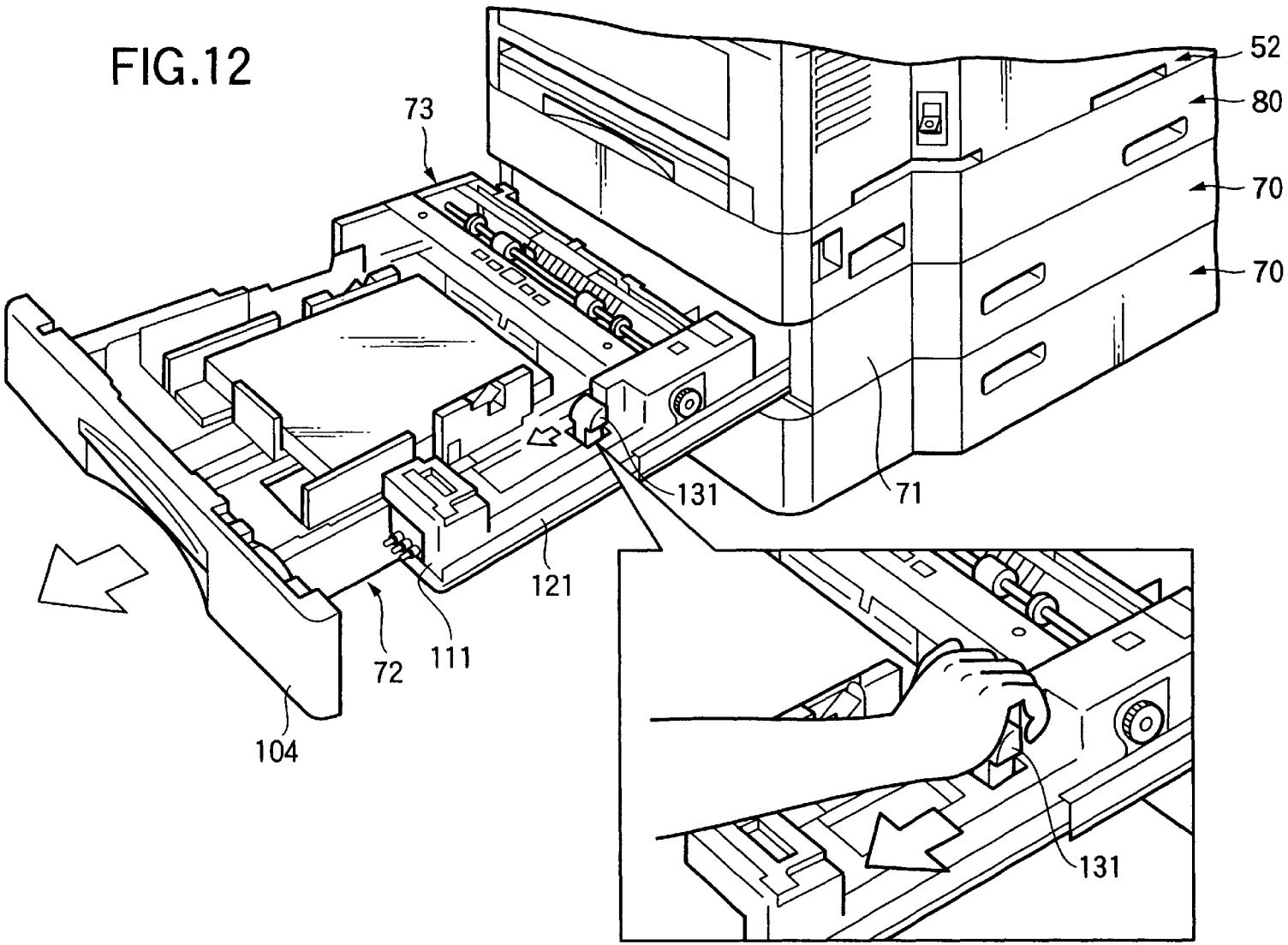
FIG. 12 is a schematic diagram illustrating the process of clearing a jam in the paper feeding unit.

Subsequently, the user turns down the lever 131, which came out of the housing 71, toward this side of the apparatus in FIGS. 11 and 12 (in the rightward direction in FIG. 10A).

Figure 10B:
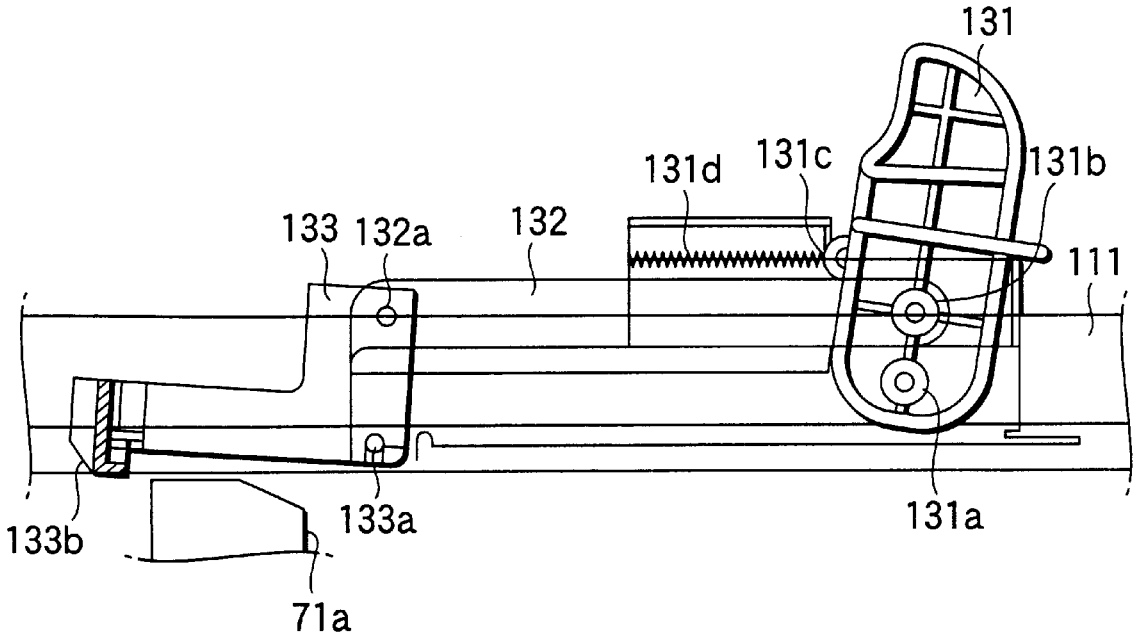

Then, as shown in FIG. 10B, the engagement between the hook 133*b* and the projection 71*a* is canceled. In this state, if the user further pulls out the lever 104, the paper-feeding-mechanism base 111 (and the paper feeding mechanism 73) is further drawn out while sliding on the outer rails 121 in the form of being pulled by the paper feeding cassette 72.

Then, immediately after the entire paper feeding mechanism 73 comes out of the housing 71, the outer rails 121 are fully extended, and the drawing out of the paper feeding cassette 72 and the paper feeding mechanism 73 is finally stopped.

Then, the user rotates the outer chute 114 shown in FIG. 8 by pushing it so as to open the paper transporting passages (two transporting passages respectively formed between the outer chute 114 and the inner chute 115 and between the inner chute 115 and the transport roll 113*b*), and pulls out the jammed paper, thereby completing the clearing of the jam.

In this embodiment, since the paper feeding mechanism 73 is made capable of being drawn out toward this side of the housing 71 (toward this side of the image forming apparatus), even in a case where a paper jam is occurred in the paper transporting passage provided on the innermost recess side of the paper feeding cassette 72, the removal of the jammed paper can be effected from the user side (this side of the image forming apparatus)

Clearing of a Jam in the Intermediate Transport Unit 80

Next, a description will be given of a method of clearing a paper jam occurring in the intermediate transport unit 80.

Figure 15:
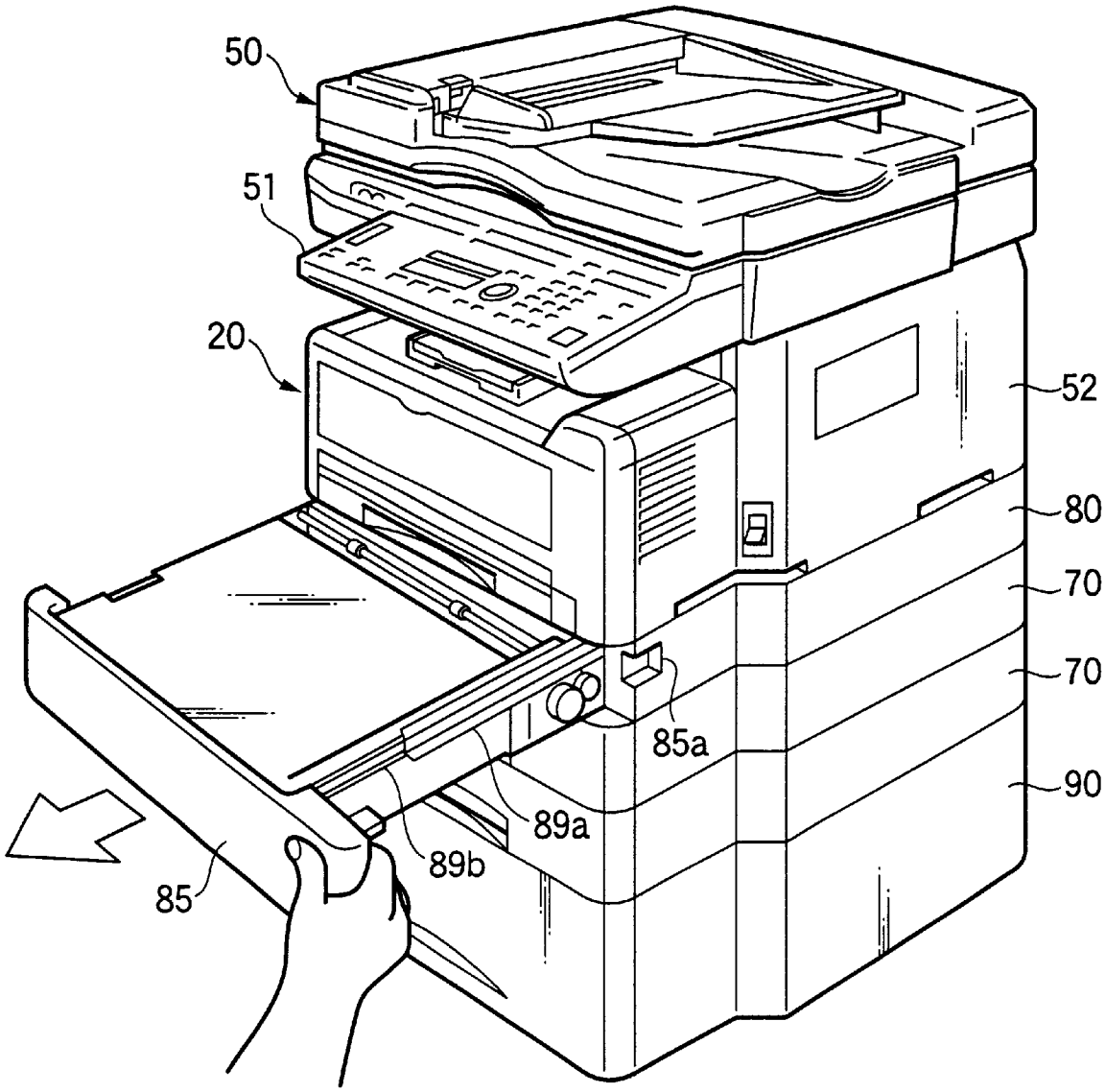
FIG. 15 is an explanatory diagram illustrating the process (1) of clearing a jam in the intermediate transport unit.

In the intermediate transport unit 80, jams are likely to occur at the portions indicated at J3 to J5 in FIG. 4, for instance, and in a case where a paper jam is occurred inside the intermediate transport unit 80, the user first pulls out the intermediate transport tray 85 toward this side of the apparatus, as shown in FIG. 15.

Here, in the image forming apparatus in accordance with this embodiment, as shown in FIG. 2, in contrast to the fact that the levers 72*a* of the paper feeding cassettes 72 are provided on this side of the apparatus, a lever 85*a* of the intermediate transport tray 85 is provided on a side surface of the apparatus, making it possible to prevent erroneous operation by the user.

At this time, in the intermediate transport tray 85, the paper nipping lever 88 moves in the direction of arrow A in FIG. 14A in conjunction with the pulling out of the intermediate transport tray 85, and forcibly nips the paper being jammed in the paper transporting passage 81.

Figure 16:
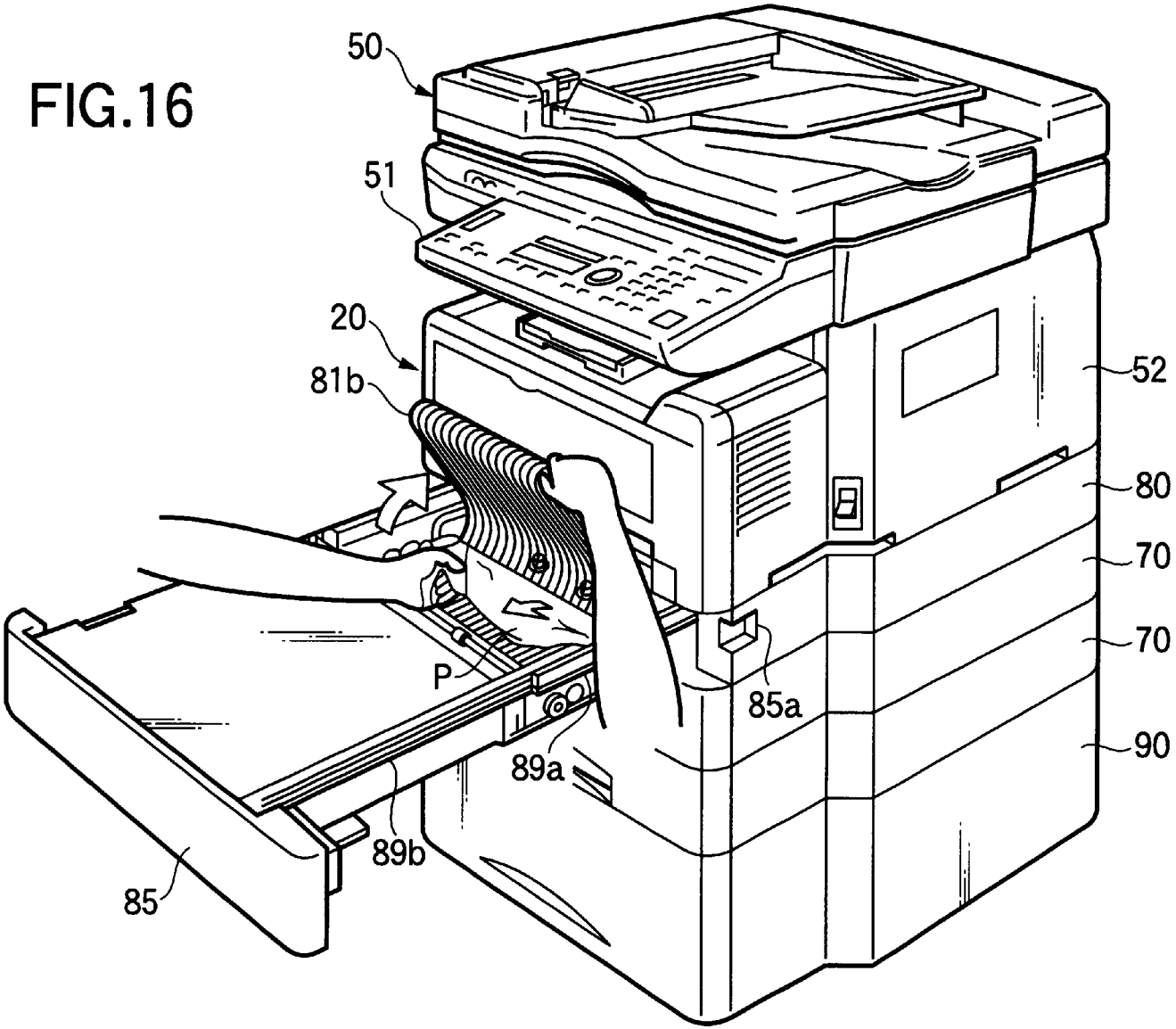
FIG. 16 is an explanatory diagram illustrating the process (2) of clearing a jam in the intermediate transport unit.

In should be noted that, in FIGS. 15 and 16, reference numerals 89*a* and 89*b* denote rails for pulling out which are respectively provided on both side surfaces of the intermediate transport tray 85.

Then, the user pulls out the intermediate transport tray 85 up to its end portion (in this embodiment, an unillustrated stopper mechanism is provided at the end portion to prevent the intermediate transport tray 85 from coming off the intermediate transport unit 80). In this state, this time the user rotates the intermediate tray cover 81*b* to open the paper transporting passage 81 and the paper nipping lever 88, and pulls out the paper P which jammed, thereby completing the clearing of the jam.

In this embodiment, since the intermediate transport tray 85 is made capable of being pulled out toward this side of the apparatus, even in a case where a paper jam is occurred in the paper transporting passage 81 provided on the innermost recess side of the intermediate transport tray 85, the removal of the jammed paper can be effected from the user side (this side of the image forming apparatus).

Clearing of a Jam in the Printer Unit 20

If it is now assumed that paper is jammed in the vicinity of the resist roll 29 inside the printer unit 20, the vicinity of the photoconductor drum 21, or the vicinity of the fixing unit 26 (corresponding to J1 in FIG. 4, for example), the paper jam is detected by an unillustrated jam detecting system, and the detected state of the jam is warned by being displayed on the operation panel 51.

In this case, as shown in FIG. 17A, the user first opens the image reading unit 50 upwardly, as indicated by the phantom lines in FIG. 17A.

At this time, in this embodiment, since the platen cover 50 is in a state of being fixed to the original placing table 503 by the latch mechanism 510, the situation does not occur in which the platen cover 506 is opened unnecessarily when the image reading unit 50 is opened.

Figure 20:
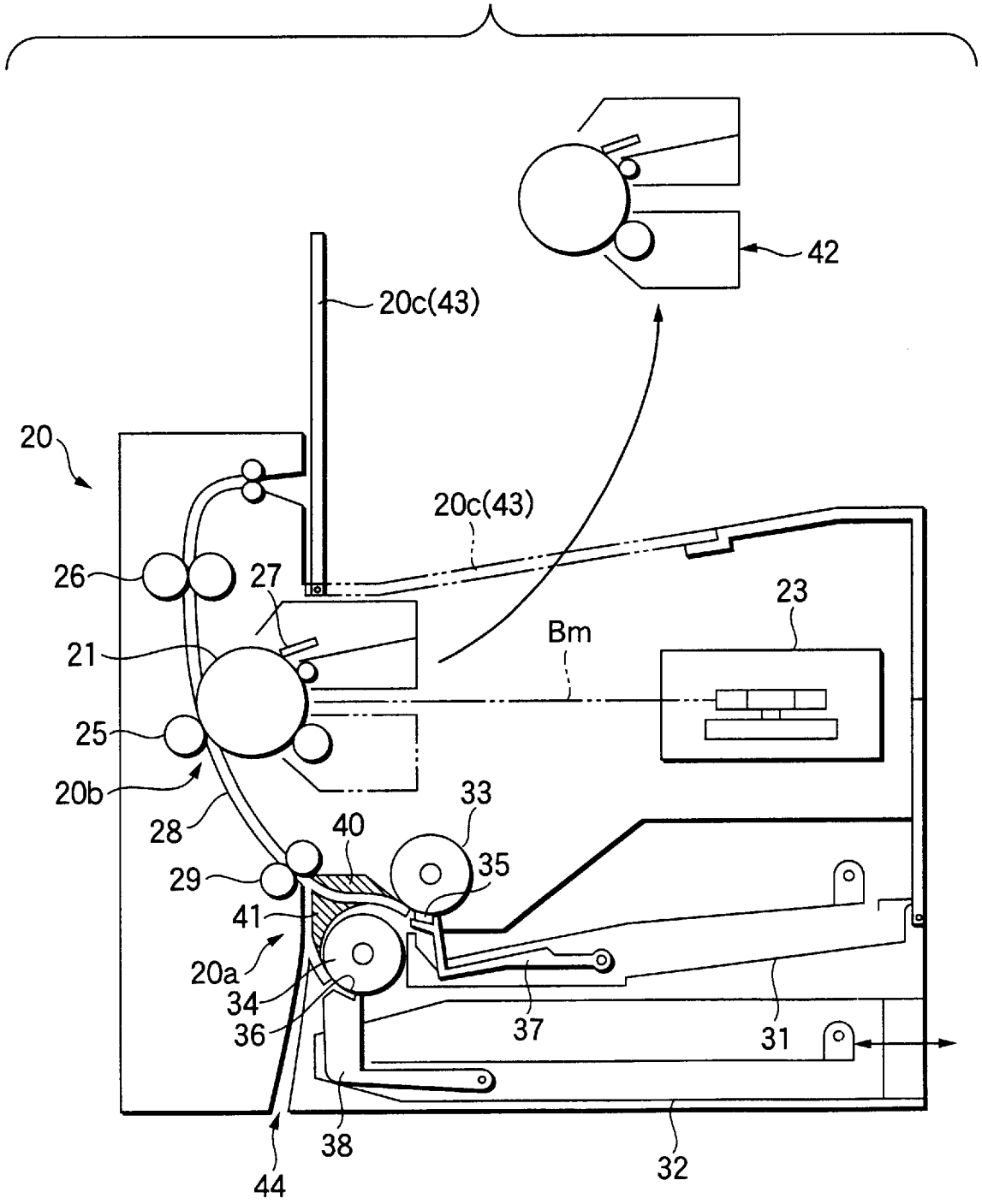
FIG. 20 is an explanatory diagram illustrating the process of clearing a jam in the printer unit.

In this state, as shown in FIG. 20, after the top cover 43 which also serves as the discharge tray 20*c* of the printer unit 20 is opened, if the process cartridge 42 is removed to the outside, and the space from which the process cartridge 42 was removed is made use of, the clearing of the jam inside the printer unit 20 can be effected.

(Second Embodiment)

Figure 21:
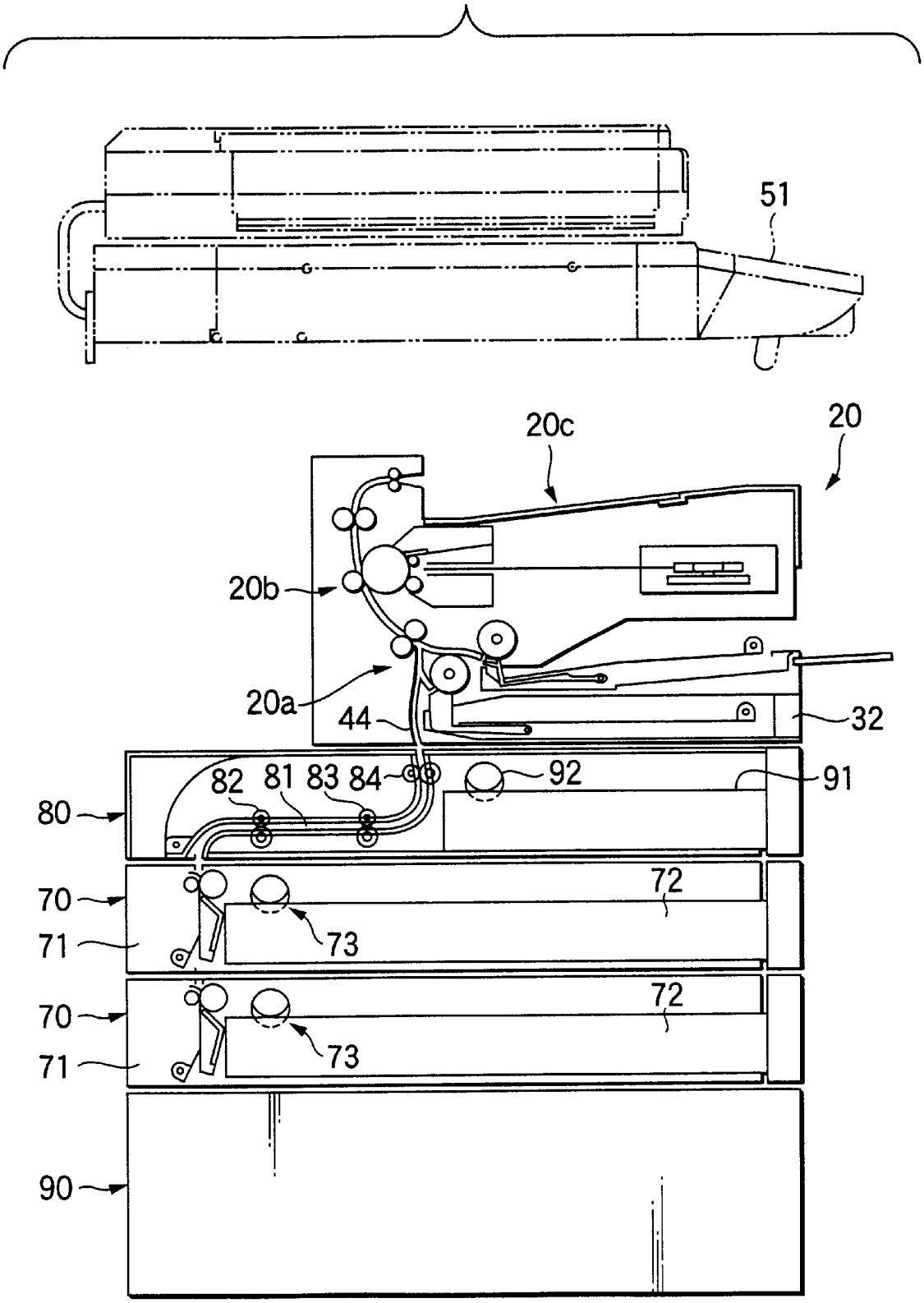
FIG. 21 is an explanatory diagram illustrating the image forming apparatus in accordance with a second embodiment.

Although this embodiment is substantially similar to the first embodiment, the intermediate transport unit 80 is further provided with a paper feeding cassette 91, as shown in FIG. 21.

It should be noted that, of the constituent elements of the image forming apparatus in accordance with this embodiment, those which are similar to those of the image forming apparatus in accordance with the first embodiment will be denoted by the same reference numerals, and a detailed description thereof will be omitted here.

Paper of the same size as that in the paper tray 32 of the printer unit 20 or paper of a smaller size is accommodated in the paper feeding cassette 91 so that the paper feeding cassette 91 will not cause a hindrance to the paper transporting passage 81.

In addition, a paper feed roll 92 is disposed on the innermost recess side of the paper feeding cassette 91 so as to feed out the paper toward the paper transporting passage 81.

In addition, since the paper feeding cassette 91 is provided on the intermediate transport tray 85 (not shown in FIG. 21; see FIG. 12) which can be pulled out, the loading of paper in the paper feeding cassette 91 is also facilitated.

In this embodiment, since the paper feeding cassette 91 and the paper feed roll 92 are provided in the intermediate transport unit 80 as well so as to reduce the empty space, the space efficiency can be further enhanced.

(Third Embodiment)

Figure 22:
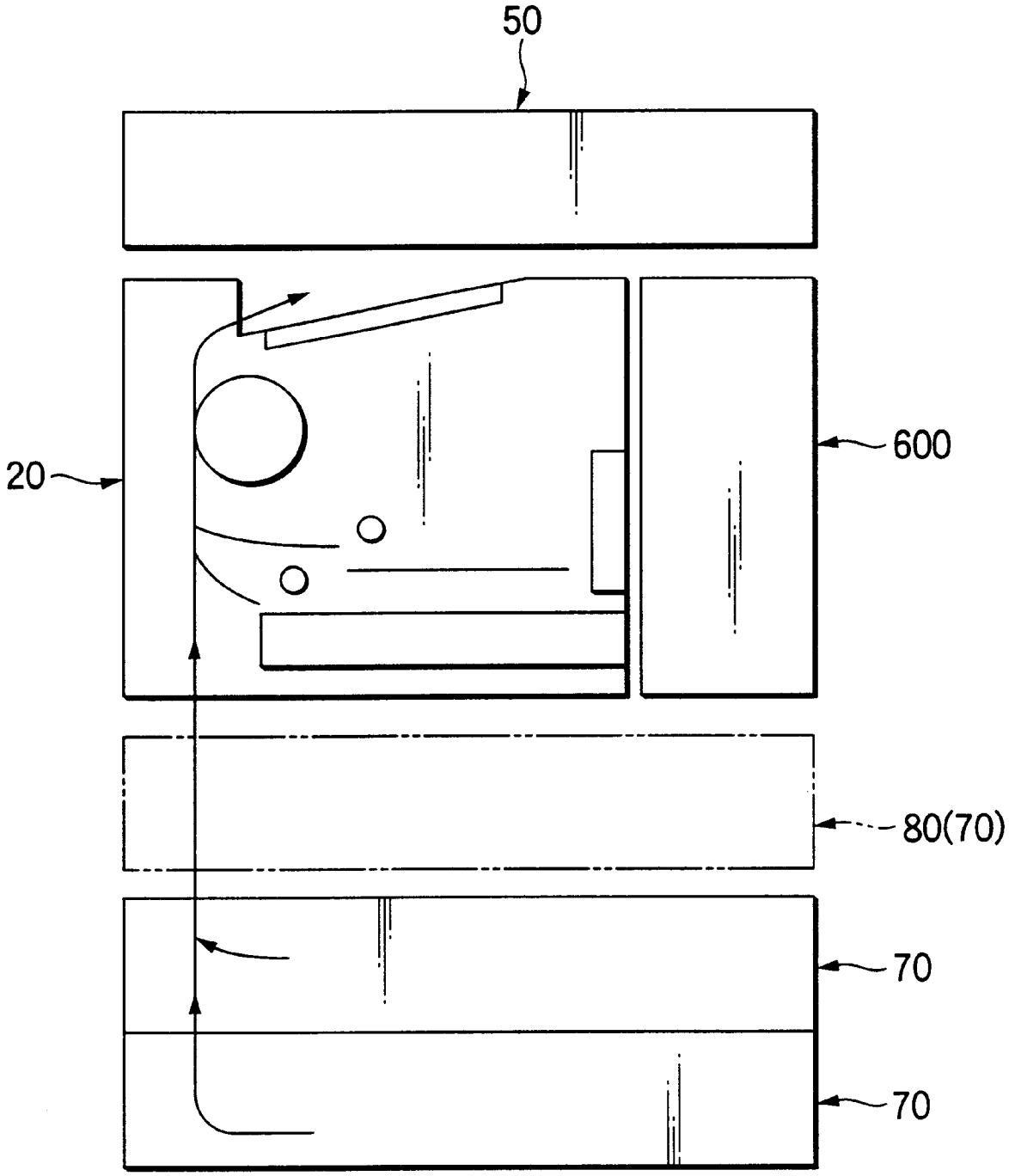
FIG. 22 is an explanatory diagram illustrating an outline of the image forming apparatus in accordance with a third embodiment.

FIG. 22 is a schematic diagram illustrating an outline of the image forming apparatus in accordance with a third embodiment.

In this embodiment, in the same way as the first embodiment, to make it possible to accommodate paper larger than the paper accommodated in the paper tray 32 of the printer unit 20, the depth of the paper feeding units 70 is set to be larger than the depth of the printer unit 20.

However, in this embodiment, unlike the first embodiment, the printer unit 20 is disposed in such a manner as to offset on the opposite side of the operation panel 51 side (this side) of the image forming apparatus, and the rear-side paper transporting passages of the paper feeding units 70 and the paper transporting passage of the printer unit 20 are arranged in a substantially rectilinearly communicating manner.

In this mode, since a space is provided on this side of the printer unit 20, to keep the appearance attractive a dummy cover 600 is provided on this side of the printer unit 20 in the range of the area occupied by the paper feeding unit 70, so that at a glance the image forming apparatus as a whole appears to be box-shaped. Incidentally, it goes without saying that the operation panel 51 may, for example, be provided at a portion of the dummy cover 600.

In addition, in this embodiment, since the paper transporting passages of the paper feeding units 70 and the printer unit 20 are connected substantially rectilinearly, it suffices if a rectilinear paper transporting passage is formed in the intermediate transport unit 80 located between the units 70 and 20. Further, in this mode, an additional paper feeding unit 70 may be installed instead of the intermediate transport unit 80.

(Fourth Embodiment)

Figure 23:
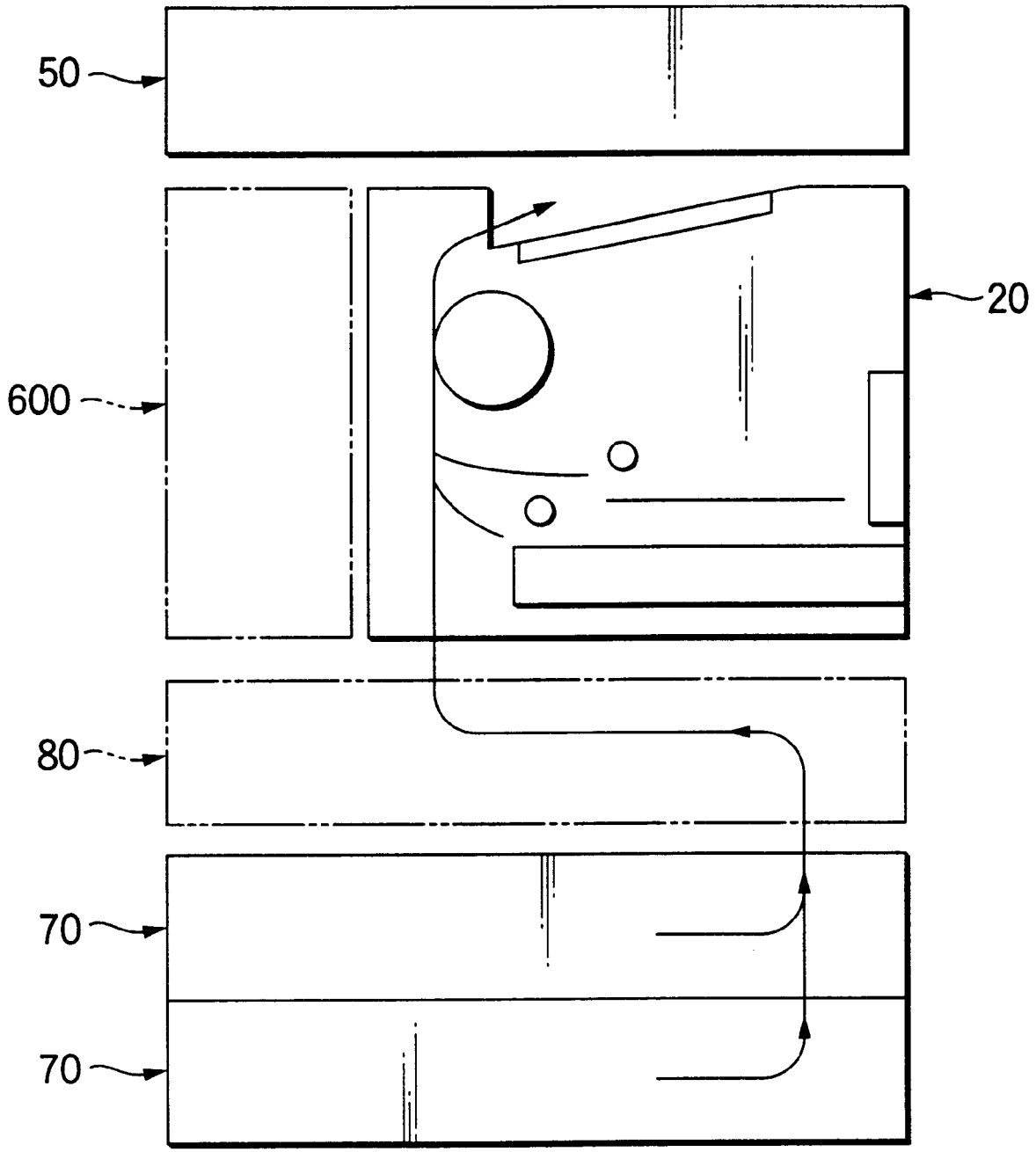
FIG. 23 is an explanatory diagram illustrating an outline of the image forming apparatus in accordance with a fourth embodiment.

FIG. 23 is a schematic diagram illustrating an outline of the image forming apparatus in accordance with a fourth embodiment.

In this embodiment, the paper feeding units 70 feed the paper from this side of the image forming apparatus. In this case, although the paper transporting paths of the paper feeding units 70 and the paper transporting path of the printer unit 20 are offset from each other between the front side and the rear side of the image forming apparatus, in this mode as well it suffices if the intermediate transport unit 80 is interposed between the units 20 and 70. Incidentally, the reference numeral 600 denote the dummy cover which is provided, as required.

(Fifth Embodiment)

Figure 24:
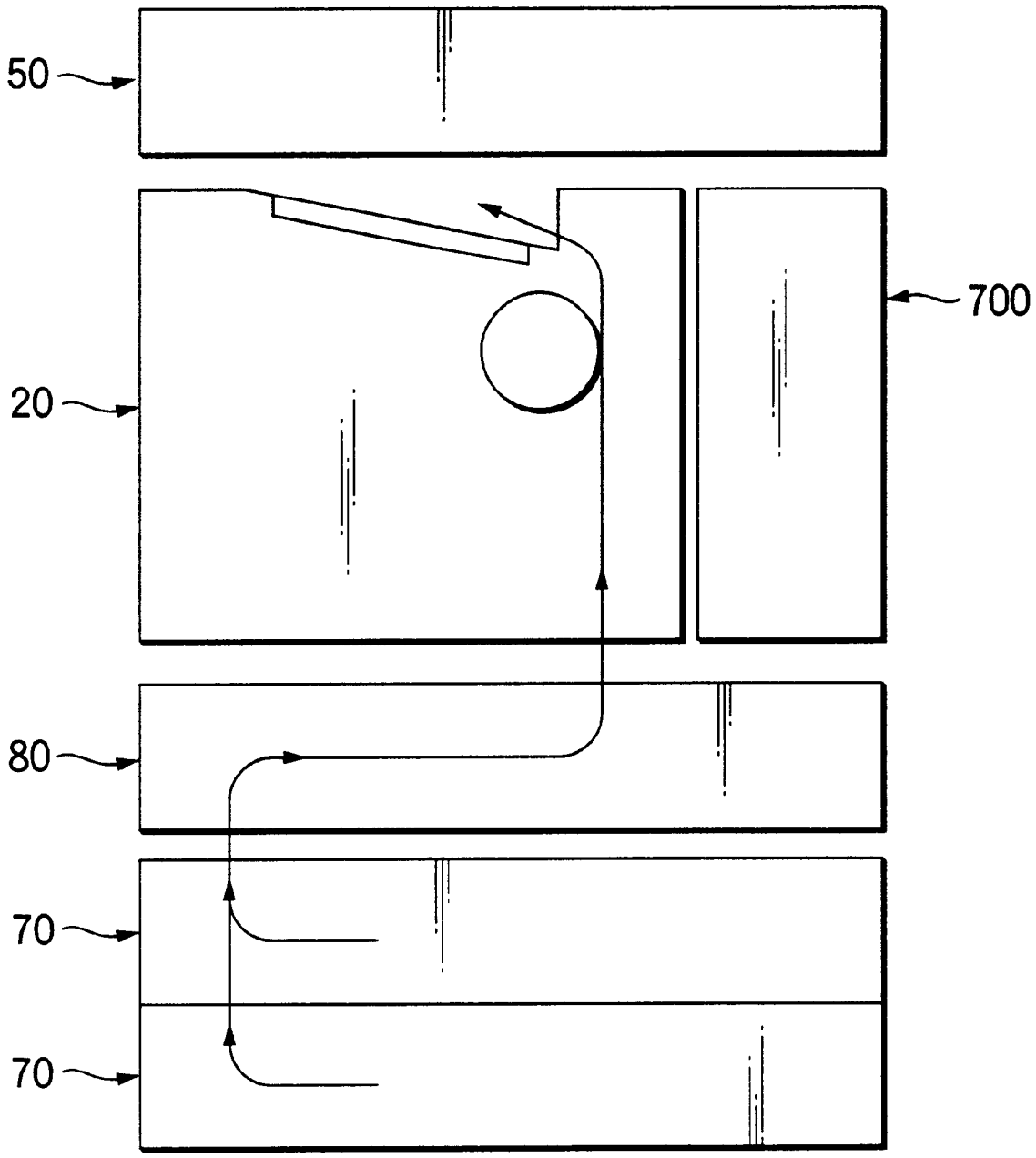
FIG. 24 is an explanatory diagram illustrating an outline of the image forming apparatus in accordance with a fifth embodiment.
Figure 25A:
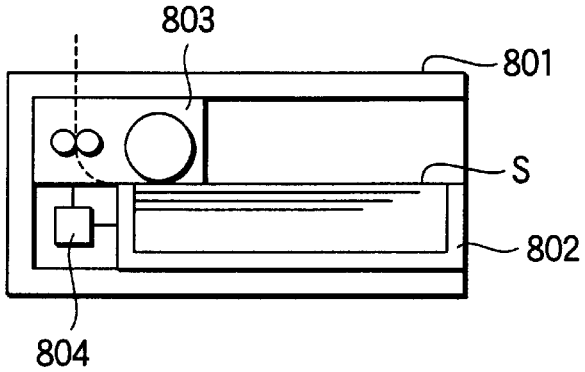
FIGS. 25A to 25D are explanatory diagram illustrating an outline of an image forming apparatus in accordance with the invention.
Figure 25B:
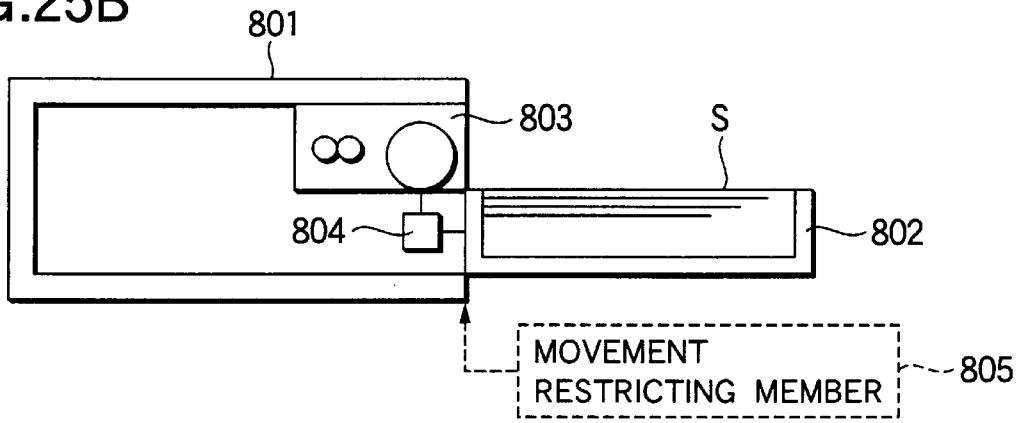
Figure 25C:
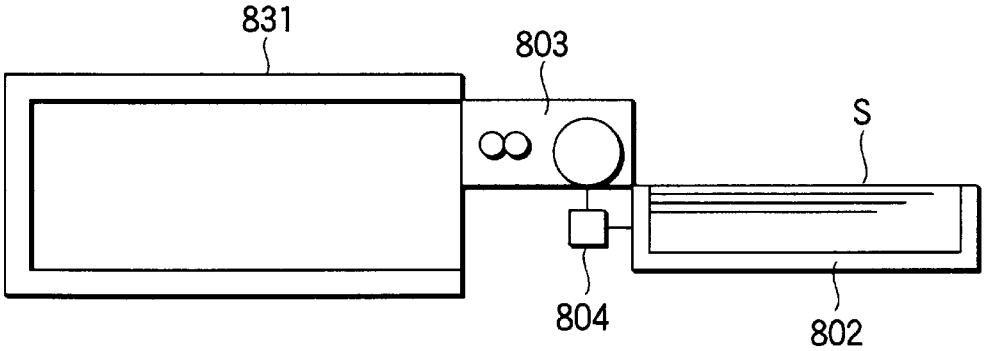
Figure 25D:
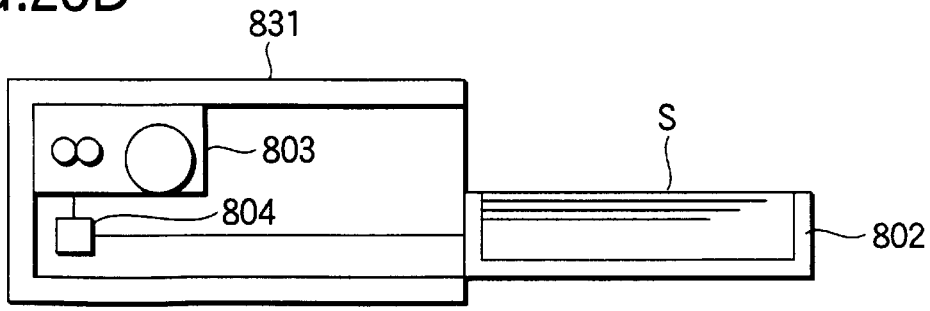

FIG. 24 is a schematic diagram illustrating an outline of the image forming apparatus in accordance with a fifth embodiment.

In this embodiment, a duplexing unit 700 for recording on both sides is added to the printer unit 20, for example, and the duplexing unit 700 is used for the paper fed from the paper feeding unit 70 to permit the formation of two-sided images.

In this case, if, for example, the printer unit 20 excluding the duplexing unit 700 is formed to be smaller than the paper feeding units 70, and if the printer unit 20 is disposed in an offset manner on the opposite side of the operation panel 51 side (this side) of the image forming apparatus, while the duplexing unit 700 is disposed on this side of the printer unit 20, then the clearing of a jam inside the duplexing unit 700 can be also coped with by clearing the jam on this side of the image forming apparatus.

(Sixth Embodiment)

Further, a detailed description will be given of the invention on the basis of a sixth embodiment shown in the appended drawings.

FIG. 5 illustrates a desk-top laser printer (image forming unit 20) used in an embodiment of an image forming apparatus to which the invention is applied.

In the drawing, the image forming unit 20 has a paper feeding section 20*a* for feeding paper, an image forming section 20*b* for forming an image of the fed paper, and a discharge tray 20*c* onto which the paper after image formation is discharged.

Here, the image forming section 20*b* forms an image by using an electrophotographic process, and is comprised of a photoconductor drum 21; a charging unit 22 for electrostatically charging the surface of the photoconductor drum 21 uniformly; a latent-image writing unit 23 for forming an electrostatic latent image by radiating a laser beam Bm to the photoconductor drum 21 on the basis of image data; a developing unit 24 for making the latent image visible by selectively transferring a toner; a transfer unit 25 for transferring a toner image on the surface of the photoconductor drum 21 onto the paper (not shown) being fed along a paper transporting passage 28; a fixing unit 26 for fixing the toner image on the paper by heating and/or pressurizing the toner image; and a cleaning unit 27 for cleaning the toner remaining on the photoconductor drum 21 after transfer.

It should be noted that reference numeral 29 denotes a pair of registration rolls disposed on the upstream side of the paper transporting passage 28 and adapted to transport the paper fed out from the paper feeding section 20*a*, which will be described later, to a toner-image transferring position at a predetermined timing.

In addition, the paper feeding section 20*a* has two paper trays 31 and 32 disposed at upper and lower positions; a first paper feed roll 33 and a second paper feed roll 34 for feeding out the paper from the upper or lower paper tray 31 or 32; paper separating members 35 and 36 which are respectively brought into pressure contact with the paper feed rolls 33 and 34; and holders 37 and 38 attached rotatably to the respective paper trays 31 and 32 to support the paper separating members 35 and 36.

Of the aforementioned paper trays 31 and 32, the paper tray 32 disposed on the lower side is detachable with respect to the image forming unit 20, and can be pulled out toward this side (the right-hand side in FIG. 5) of the image forming unit 20. Further, in this embodiment, when the paper tray 32 in which paper for the longitudinal feeding of the JIS standard A4 size is accommodated is loaded, the entire paper tray 32 is accommodated in the image forming unit 20 (see FIG. 5).

On the other hand, the paper tray 31 on the upper side is used as a manual feeding tray, and the paper of a desired size can be easily inserted from this side of the image forming unit 20.

It should be noted that reference numeral 39 denotes a manual feed assisting tray provided openably on this side of the paper tray 31, and reference numerals 40 and 41 denote paper guides for guiding the paper fed out from the paper tray 31 or 32 toward the resist roll 29.

Further, in this image forming unit 20, for the purpose of improvement of the maintenance features, the photoconductor drum 21 and its peripheral units including the charging unit 22, the developing unit 24, the cleaning unit 27, and the like are formed integrally as a process cartridge 42. If a top cover 43, a portion of which serves as the discharge tray 20*c*, is opened, this process cartridge 42 can be opened upwardly of the image forming unit 20.

In the image forming unit 20, since the process cartridge 42 is detachably arranged, not only can the replacement of the process cartridge 42 be facilitated, but in the event that a paper jam has occurred in the image forming unit 20, the paper can be easily removed by detaching this process cartridge 42. Further, in the case where the process cartridge 42 has been detached, since the paper guides 40 and 41 are disposed in such a manner as to be swingable about the axis of one of the resist rolls 29, it is possible to easily clear a jam occurring in that portion by moving these paper guides 40 and 41.

It should be noted that reference numeral 44 denotes a paper transporting passage which is provided on the innermost recess side of the paper tray 32 and along which the paper fed out from an external paper feeding unit 70 (see FIG. 4), which will be described later, is transported.

FIG. 2 shows a perspective view of this embodiment of the image forming apparatus which is configured on the basis of the image forming unit 20 (desk-top laser printer) shown in FIG. 5. This image forming apparatus is a so-called combination machine having the respective functions of a copying machine, a facsimile machine, a printer, and a scanner.

In the drawing, the image forming apparatus in accordance with this embodiment is provided with the aforementioned image forming unit 20, an automatic original reading unit 50 disposed on top of the image forming unit 20, and a paper feeding unit 60 disposed below the image forming unit and adapted to feed paper and serving as the sheet feeder. Further, an operation panel 51 is provided on this side of the automatic original reading unit 50.

In addition, FIG. 3 shows a side elevational view of the image forming apparatus shown in FIG. 2.

Here, in the image forming apparatus in accordance with this embodiment, to make it possible to accommodate paper larger than the paper accommodated in the paper tray 32 of the image forming unit 20, the depth of the paper feeding unit 60 is set to be larger than the depth of the image forming unit 20.

Further, in this embodiment, the image forming unit 20 is disposed in such a manner as to be offset on this side (on the operation panel 51 side) of the image forming apparatus, such that front faces of the image forming unit 20 and the paper feeding unit 60 are formed substantially flush.

It should be noted that a pair of supporting walls 52 for supporting the automatic original reading unit 50 are respectively disposed on both side surfaces of the image forming unit 20, so that a predetermined space is formed over the discharge tray 20*c* (FIG. 5) of the image forming unit 20.

Next, referring to FIG. 4, a description will be given of the paper feeding unit 60. It should be noted that, in FIG. 4, the illustration of the automatic original reading unit 50 is omitted.

In this embodiment, the paper feeding unit 60 has two external paper feeding units 70 which are capable of accommodating paper larger than the paper accommodated in the paper tray 32 of the image forming unit 20, e.g., paper of the JIS standard A3 size.

This external paper feeding unit 70 has a housing 71, an external paper feeding tray 72 which can be pulled out toward this side (the right-hand side in FIG. 4) of the image forming apparatus, and a paper feeding mechanism 73 disposed in an upper portion of an inner recessed portion of the external paper feeding tray 72 in the inserting direction thereof and adapted to feed out the paper in the inserted external paper feeding tray 72 toward the image forming unit 20 side.

FIG. 7A shows a state in which the external paper feeding tray 72 and the paper feeding mechanism 73 of the above-described external paper feeding unit 70 have been pulled out.

In the drawing, the external paper feeding tray 72 has a tray base 101, a bottom plate 102 disposed in such a manner as to extend from a substantially central portion of the external paper feeding tray 72 toward the innermost recess side, in the inserting direction, of the external paper feeding tray 72, and an end guide 103 for paper disposed in such a manner as to be movable from a substantially central portion of the external paper feeding tray 72 toward this side in the inserting direction. Further, the bottom plate is swingable about a shaft 102*a* provided in the substantially central portion of the paper feeding tray, and is urged upward in the drawing by an unillustrated urging member such as a spring. Incidentally, reference numeral 104 denotes a lever for drawing out the external paper feeding tray 72.

Meanwhile, the paper feeding mechanism 73 has a paper-feeding-mechanism base 111, a semicircular feed roll 112 for paying out the sheet (not shown) placed in the external paper feeding tray 72, a pair of transport rolls 113 (113*a*, 113*b*) for transporting the paper paid out, and an outer chute 114 and an inner chute 115 for guiding the paper being transported.

In addition, corner separators 105 (see FIG. 7B) are respectively provided at both ends on the innermost recess side, in the inserting direction, of the external paper feeding tray 72, and are adapted to feed out one sheet at a time the paper paid out by the feed roll 112.

It should be noted that reference numerals 116 and 117 denote gears for transmitting the driving force to the feed roll 112 and the transport roll 113*b*, respectively.

As shown in FIG. 8, the outer chute 114 is rotatable about a shaft 114*a* provided at a lower end of the paper-feeding-mechanism base 111, and the transport roll 113*a* is attached to a distal end portion of its free end. Further, this outer chute 114 is urged toward the feed roll 112 side by an unillustrated urging member such as a spring, and is normally positioned at the position indicated by the solid lines in the drawing.

Meanwhile, the inner chute 115 is also rotatable about a shaft 115*a* provided at a lower side of the paper-feeding-mechanism base 111. This inner chute 115 is normally positioned at the position indicated by the solid lines in the drawing by the urging force for the outer chute 114.

In addition, a paper nipping lever 118 is provided at a substantially central portion in the axial direction of the outer chute 114.

This paper nipping lever 118 has a curved surface substantially similar to that of the outer chute 114, and is urged toward the feed roll 112 by an unillustrated torsion spring. Further, when the paper feeding mechanism 73 is accommodated on the innermost recess side, the rear surface of the paper nipping lever 118 is pressed by an unillustrated projection provided in the housing 71 and is thus formed substantially flush with the outer chute 114, thereby assuming a state in which the paper transporting passage is not blocked. On the other hand, when the paper feeding mechanism 73 is pulled out of the housing 71, the pressing by the unillustrated projection is canceled, thereby assuming a state in which the paper transporting passage is blocked by the urging force of the unillustrated torsion spring.

In addition, as schematically shown in FIGS. 9A to 9C, in the external paper feeding unit 70 in accordance with this embodiment, the paper-feeding-mechanism base 111 of the paper feeding mechanism 73 is supported slidably with respect to the housing 71 by means of outer rails 121 (121*a*, 121*b*). Further, the tray base 101 of the paper feeding unit 72 is supported slidably with respect to the paper-feeding-mechanism base 111 by means of inner rails 122 (122*a*, 122*b*).

Consequently, with the external paper feeding unit 70 in accordance with this embodiment, not only can the external paper feeding tray 72 be pulled out from this side of the housing 71, but the paper feeding mechanism 73 can be also pulled out from this side of the housing 71.

On the paper-feeding-mechanism base 111, a temporary lock mechanism 130 for temporarily locking the drawing out of the paper feeding mechanism 73 is provided at a portion positioned between the outer rail 121*a* and the inner rail 122*a*.

As shown in FIG. 10A, this temporary lock mechanism 130 has a lever 131 which swings about a shaft 131*a* provided on the paper-feeding-mechanism base 111, an I-shaped first arm 132 linked to a shaft 131*b* provided above the shaft 131*a*, and an L-shaped second arm 133 linked to a shaft 132*a* provided at the other end of the first arm 132. This second arm 133 is swingable about a shaft 133*a* provided on the paper-feeding-mechanism base 111, and a hook 133*b* having an inclined surface at one end thereof and a vertical surface at the other end thereof is provided at the free end portion thereof.

The lever 131 is loaded with a spring 131*d* at a hole 131*c*, so that the lever 131 is normally adapted to be urged leftward in the drawing.

Meanwhile, as shown in FIGS. 9 and 10, of the bottom surface of the housing 71, a projection 71*a* with which the hook 133*b* is engaged is formed on a portion located on this side in the inserting direction of the external paper feeding tray 72.

This projection 71*a* is so arranged that, in correspondence with the hook 133*b*, a vertical surface is formed at one end thereof, and an inclined surface is formed at the other end thereof, such that the corresponding vertical surfaces and the corresponding inclined surfaces of the hook 133*b* and the projection 71*a* are opposed to each other.

In this embodiment, as is apparent from FIG. 4, the position where the paper is discharged from the external paper feeding unit 70 and the position of the paper transporting passage 44 of the image forming unit 20 (the position where the paper is carried in) are offset from each other, the paper feeding unit 60 is provided with an intermediate transport unit 80 for aligning these paper transporting passages.

In this intermediate transport unit 80, a substantially S-shaped paper transporting passage 81 is formed for transporting the paper from the external paper feeding unit 70 to the image forming unit 20. Pairs of transport rolls 82 to 84 are arranged along this paper transporting passage 81 consecutively in that order from the upstream side in the transporting direction.

It should be noted that, in FIG. 4, reference numeral 90 denotes a stand which is disposed in the lowest portion of the paper feeding unit 60 for adjusting the height of the image forming apparatus.

Next, a description will be given of an image forming process of the image forming apparatus in accordance with this embodiment.

When the pressing down of a copy button, reception by facsimile, or reception of a print signal is effected, a predetermined image forming process is executed.

Specifically speaking, when copying, for example, is effected, the original is read by the automatic original reading unit 50, its read signal is converted into a digital image signal by an unillustrated image signal processor and is temporarily stored in an unillustrated memory, and a toner image is formed on the basis of this digital image signal.

Namely, by means of the latent-image writing unit 23 an electrostatic latent image is written on the photoconductor drum 21 which has been electrostatically charged uniformly by the charging unit 22 in response to the digital image signal inputted from the image signal processor.

Then, the electrostatic latent image thus formed is subjected to development to form a toner image.

On the other hand, the paper is transported at a predetermined timing to a transfer position where the photoconductor drum 21 and the transfer unit 25 are opposed to each other.

At the transfer position, the toner image carried on the photoconductor drum 21 is transferred onto the paper by the action of a transfer electric field formed between the photoconductor drum 21 and the transfer unit 25. The paper with the toner image transferred onto it is transported to the fixing unit 26 to undergo fixation, and is discharged onto the discharge tray 20*c* from the innermost recess side of the apparatus.

On the other hand, after the transfer, the toner remaining on the photoconductor drum 21 is cleaned by the cleaning unit 27.

Here, a description will be given of a method of loading paper in the external paper feeding unit 70 in accordance with this embodiment.

When the paper is loaded in the external paper feeding unit 70, the user first pulls out the lever 104 of the external paper feeding tray 72 toward this side of the apparatus, as shown in FIG. 11.

At this time, in the external paper feeding unit 70, the external paper feeding tray 72 is drawn out while sliding on the inner rails 122 in conjunction with the drawing out of the lever 104, as shown in FIGS. 9A and 9B, and when the inner rails 122 have been fully extended, the paper-feeding-mechanism base 111 (and the paper feeding mechanism 73) is drawn out while sliding on the outer rails 121 in the form of being pulled by the external paper feeding tray 72. Then, when the hook 133*b* of the temporary lock mechanism 130 provided on the paper-feeding-mechanism base 111 abuts against the projection 71*a*, the drawing out of the external paper feeding tray 72 and the paper feeding mechanism 73 is stopped.

At this time, the positional relationship between the external paper feeding tray 72 and the paper feeding mechanism 73 which have been drawn out is set in the state shown in FIGS. 7B and 9B, i.e., in the state in which the feed roll 112 (see FIG. 7A) located above the external paper feeding tray 72 during paper feeding is disposed on the innermost recess side relative to the external paper feeding tray 72 during drawing out.

Accordingly, as shown in FIGS. 9B and 11, nothing blocks the external paper feeding tray 72 which is exposed to the outside of the housing 71, so that the insertion of new paper is facilitated.

In addition, when only the loading of the paper is effected, since the entire paper feeding mechanism 73 is not drawn out from the housing 71 by virtue of the temporary lock mechanism 130, the length which is drawn out is made compact correspondingly.

Next, a description will be given of a method of clearing a paper jam occurring in the external paper feeding unit 70 in accordance with this embodiment.

Also in a case where the jammed paper inside the external paper feeding unit 70 is removed, the user first pulls out the lever 104 of the external paper feeding tray 72 toward this side of the apparatus, as shown in FIG. 11.

At this time, in the external paper feeding unit 70, as shown in FIGS. 9A and 9B, the external paper feeding tray 72 is first drawn out while sliding on the inner rails 122 in conjunction with the drawing out of the lever 104. Then, when the inner rails 122 have been fully extended, the paper-feeding-mechanism base 111 (and the paper feeding mechanism 73) is drawn out while sliding on the outer rails 121 in the form of being pulled by the external paper feeding tray 72.

At this time, in conjunction with the drawing out of the paper-feeding-mechanism base 111, the pressing of the paper nipping lever 118 shown in FIG. 8 is canceled and is tilted toward the paper transporting passage side, so that the paper which is jammed in the paper transporting passage is forcibly nipped.

Further, when the hook 133*b* of the temporary lock mechanism 130 provided on the paper-feeding-mechanism base 111 abuts against the projection 71*a* of the housing 71, the drawing out of the external paper feeding tray 72 and the paper feeding mechanism 73 is temporarily stopped.

Subsequently, the user turns down the lever 131, which came out of the housing 71, toward this side of the apparatus in FIGS. 11 and 12 (in the rightward direction in FIG. 10A).

Then, as shown in FIG. 10B, the engagement between the hook 133*b* and the projection 71*a* is canceled. In this state, if the user further pulls out the lever 104, the paper-feeding-mechanism base 111 (and the paper feeding mechanism 73) is further drawn out while sliding on the outer rails 121 in the form of being pulled by the external paper feeding tray 72.

Then, immediately after the entire paper feeding mechanism 73 has come out of the housing 71, the outer rails 121 are fully extended, and the drawing out of the external paper feeding tray 72 and the paper feeding mechanism 73 is finally stopped.

Then, the user rotates the outer chute 114 shown in FIG. 8 by pushing it so as to open the paper transporting passages (two transporting passages respectively formed between the outer chute 114 and the inner chute 115 and between the inner chute 115 and the transport roll 113*b*), and pulls out the jammed paper, thereby completing the clearing of the jam.

In this embodiment, since the paper feeding mechanism 73 is made capable of being drawn out toward this side of the housing 71 (toward this side of the image forming apparatus), even in a case where a paper jam has occurred in the paper transporting passage provided on the innermost recess side of the external paper feeding tray 72, the removal of the jammed paper can be effected from the user side (this side of the image forming apparatus).

[Advantages of the Invention]

As described above, in accordance with the invention, since the recording-material discharging section is disposed above the image forming section, the recording-material supplying section is disposed below the image forming section, and the rear-side transporting path is provided in a portion of the transporting paths of the recording material, it is possible to provide an image forming apparatus requiring only a small installation area without securing a wasteful space for clearing a jam.

Further, as described above, in accordance with the invention, since the sheet feeding member provided on the innermost recess side of the sheet tray is arranged to be pulled out toward this side of the apparatus in interlocking relation to the sheet tray, both the loading of the sheets and the clearing of jams can be effected from this side of the apparatus. Therefore, it is possible to easily remove the jammed sheet without causing a decline in the substantial space efficiency.

What is claimed is:

1. An image forming apparatus comprising:

an image forming section incorporating an image forming engine inside an apparatus body and adapted to form an image on a recording material by means of the image forming engine;

a recording-material discharging section disposed above the image forming section to discharge and accommodate the recording material for which the image formation by the image forming section is completed;

a recording-material supplying section which is disposed below the image forming section, in which a recording-material cassette for accommodating the recording-material is loaded in the apparatus body in such a manner as to be capable of being pulled out from a user operation side, a user operation-side surface of the recording material-cassette is set substantially flush with a surface of the apparatus body, the recording-material cassette includes a recording-material accommodating portion and a recording-material transporting portion, arranged on a rear side of the recording-material accommodating portion, and the recording-material accommodating portion and the recording-material transporting portion are capable of being exposed to the outside when the recording-material cassette is pulled out; and a recording-material transporting system in which transporting paths are provided for transporting the recording material, supplied from the recording-material supplying section, to the image forming section and for subsequently guiding the recording material to the recording-material discharging section, wherein a portion of the transporting path leading to the image forming section is arranged on a rear side of the apparatus body located on an opposite side to the user operation side, at least either one of the recording-material supplying section and the recording-material transporting system is provided with a jam clearing section for allowing the recording material jammed in a rear-side transporting path to be cleared on the user operation side.

2. The image forming apparatus according to claim 1, wherein in a mode in which the transporting path, located immediately after the recording-material supplying section, is the rear-side transporting path, the recording material cassette comprises:

a recording-material accommodating portion for accommodating the recording material; and a recording-material transporting portion disposed on an innermost recess side of the recording-material accommodating portion, wherein, the jam clearing section causes the recording-material transporting portion to be exposed to an outside with the recording material nipped and held in the recording-material transporting portion when the recording material cassette is pulled out.

3. The image forming apparatus according to claim 2, wherein the recording-material supplying section has a temporary stop mechanism for temporarily stopping the recording material cassette when the recording material cassette is pulled out to a position where the entire recording-material accommodating portion is exposed to the outside, and as the temporary stop mechanism is unlatched, the recording material cassette is capable of being further pulled out.

4. The image forming apparatus according to claim 1, the recording-material transporting system further comprising an intermediate transport section for constituting a portion of the rear-side transporting path, wherein the jam clearing section is provided in the intermediate transport section.

5. The image forming apparatus according to claim 4, wherein in a mode in which the transporting paths, for both transporting to the image forming section the recording material supplied from the recording material supplying section and subsequently guiding the recording material to the recording material discharging section has a vertically transporting path which is offset in a back and forth direction as viewed from the user operation side, the recording-material transporting system further comprises:

the intermediate transport section in which a horizontally transporting path connecting mutually offset vertically transporting paths is disposed, wherein the jam clearing section is provided in the intermediate transport section.

6. The image forming apparatus according to claim 4, wherein the jam clearing section is arranged such that a recording-material transporting portion is provided on an innermost recess side of the intermediate transport section, the intermediate transport section is made capable of being pulled out of the apparatus body from the user operation side, and the jam clearing section causes the recording-material transporting portion to be exposed to an outside with the recording material nipped and held in the recording-material transporting portion when the intermediate transport section is pulled out.

7. The image forming apparatus according to claim 1, wherein, in a mode in which a detachable image forming engine is disposed in the apparatus body, the jam clearing section is arranged such that an openable cover which can be opened or closed from the user operation side is provided on the apparatus body making up a part of the image forming section, and after the openable cover is opened and the image forming engine is detached, the recording material which jammed in the transporting path leading from the image forming section to the recording-material discharging section is cleared by making use of a space for detaching the image forming engine.

8. The image forming apparatus according to claim 7, wherein the recording-material discharging section is formed integrally on top of an apparatus body portion of the image forming section, and the recording-material discharging section is provided with an openable cover.

9. The image forming apparatus according to claim 1, wherein the image forming section and the recording-material supplying section are formed such that the respective apparatus body portions thereof, located on the user operation side, are made substantially flush.

10. The image forming apparatus according to claim 1, wherein, in a mode in which an apparatus body portion of the image forming section has an occupying area smaller than that of an apparatus body portion of the recording-material supplying section, a dummy cover is disposed on either the user operation side or the rear side of the image forming section, such that an area occupied by the apparatus body portion of the image forming section and the dummy cover is substantially equal to the occupying area of the apparatus body portion of the recording-material supplying section.

11. The image forming apparatus according to claim 1, the image forming section comprising a recording-material-two-side transporting section allowing formation of images on both sides of the recording material by the image forming engine.

12. The image forming apparatus according to claim 1, further comprising an image reading section disposed above the recording-material discharging section with at least a space provided therebetween, the space being open on the user operation side, the image reading section having an original placing table on which an original is fixed, so as to read an image of the original.

13. The image forming apparatus according to claim 12, wherein, in a mode in which the recording-material discharging section is formed integrally on top of an apparatus body portion of the image forming section, and the recording-material discharging section is provided with an openable cover for attaching or detaching the image forming engine, and the image reading section is disposed movably in a space above the recording-material discharging section so as to make the space above the recording-material discharging section more open.

14. The image forming apparatus according to claim 12, wherein the image reading section, the image forming section, and the recording-material supplying section are formed such that the respective apparatus body portions thereof located on the user operation side are made substantially flush.

15. A sheet feeder comprising:

a sheet tray for accommodating sheets of paper, disposed in such a manner as to be capable of being inserted or pulled out from the operation side of an apparatus body;

a sheet feeding member disposed on an innermost recess side of the sheet tray in an inserting direction thereof so as to feed out the sheet in the sheet tray; and an interlocking mechanism for moving the sheet feeding member in a same direction as that of the sheet tray in interlocking relation to the sheet tray.

16. The sheet feeder according to claim 15, wherein the sheet feeding member is moved so as to offset a relative positional relationship in a moving direction between the sheet tray and the sheet feeding member.

17. The sheet feeder according to claim 15, further comprising a movement restricting member for temporarily restricting the movement, in a pulling-out direction, of the sheet tray at a position where the sheet tray is pulled out of the apparatus body and where the sheet feeding member is accommodated in the apparatus body.

18. An image forming apparatus comprising:

an image forming section incorporating an image forming engine inside an apparatus body and adapted to form an image on a recording material by means of the image forming engine;

a recording-material discharging section disposed above the image forming section to discharge and accommodate the recording material for which the image formation by the image forming section is completed;

a recording-material supplying section which is disposed below the image forming section, in which a recording-material cassette for accommodating the recording-material is loaded in the apparatus body in such a manner as to be capable of being pulled out from a user operation side, a user operation-side surface of the recording material-cassette is set substantially flush with a surface of the apparatus body, and in a mode in which the transporting path, located immediately after the recording-material supplying section, is the rear-side transporting path, the recording material cassette comprises:

a recording-material accommodating portion for accommodating the recording material; and a recording-material transporting portion disposed on an innermost recess side of the recording-material accommodating portion, wherein, the jam clearing section causes the recording-material transporting portion to be exposed to an outside with the recording material nipped and held in the recording-material transporting portion when the recording material cassette is pulled out; and a recording-material transporting system in which transporting paths are provided for transporting the recording material, supplied from the recording-material supplying section, to the image forming section and for subsequently guiding the recording material to the recording-material discharging section, wherein a portion of the transporting path leading to the image forming section is arranged on a rear side of the apparatus body located on an opposite side to the user operation side, at least either one of the recording-material supplying section and the recording-material transporting system is provided with a jam clearing section for allowing the recording material jammed in a rear-side transporting path to be both accessed from and cleared only on the user operation side.

19. An image forming apparatus comprising:

an image forming section incorporating an image forming engine inside an apparatus body and adapted to form an image on a recording material by means of the image forming engine;

a recording-material discharging section disposed above the image forming section to discharge and accommodate the recording material for which the image formation by the image forming section is completed;

a recording-material supplying section which is disposed below the image forming section, in which a recording-material cassette for accommodating the recording-material is loaded in the apparatus body in such a manner as to be capable of being pulled out from a user operation side, a user operation-side surface of the recording material-cassette is set substantially flush with a surface of the apparatus body;

a recording-material transporting system in which transporting paths are provided for transporting the recording material, supplied from the recording-material supplying section, to the image forming section and for subsequently guiding the recording material to the recording-material discharging section, wherein a portion of the transporting path leading to the image forming section is arranged on a rear side of the apparatus body located on an opposite side to the user operation side, at least either one of the recording-material supplying section and the recording-material transporting system is provided with a jam clearing section for allowing the recording material jammed in a rear-side transporting path to be both accessed from and cleared only on the user operation side.

* * * * *